US011225270B2

(12) United States Patent
Wang et al.

(10) Patent No.: US 11,225,270 B2
(45) **Date of Patent: *Jan. 18, 2022**

(54) CHASSIS COMPONENT OF RAILWAY VEHICLE, AND RAILWAY VEHICLE

(71) Applicant: CRRC QINGDAO SIFANG CO., LTD., Qingdao (CN)

(72) Inventors: Yu Wang, Qingdao (CN); Aiqin Tian, Qingdao (CN); Haiyang Yu, Qingdao (CN); Longxi Liu, Qingdao (CN); Chenggong Zhang, Qingdao (CN)

(73) Assignee: CRRC QINGDAO SIFANG CO., LTD., Qingdao (CN)

( * ) Notice: Subject to any disclaimer, the term of this patent is extended or adjusted under 35 U.S.C. 154(b) by 465 days.

This patent is subject to a terminal disclaimer.

(21) Appl. No.: 16/197,549

(22) Filed: Nov. 21, 2018

(65) Prior Publication Data

US 2019/0084591 A1 Mar. 21, 2019

(30) Foreign Application Priority Data

Sep. 6, 2018 (CN) ..... 201811038248.1

(51) Int. Cl.
*B61F 1/12* (2006.01)
*B61F 1/04* (2006.01)
(Continued)

(52) U.S. Cl.
CPC ..... *B61F 1/12* (2013.01); *B61D 17/10* (2013.01); *B61F 1/00* (2013.01); *B61F 1/04* (2013.01);
(Continued)

(58) Field of Classification Search
CPC ..... B61F 1/00; B61F 1/08; B61F 1/10; B61F 1/02; B61F 5/02; B61F 5/04; B61F 1/12;
(Continued)

(56) References Cited

U.S. PATENT DOCUMENTS 2,080,757 A * 5/1937 Blomberg ..... B61D 27/0036 454/99
3,486,241 A * 12/1969 Coyle ..... B61D 27/0027 34/540
(Continued)

FOREIGN PATENT DOCUMENTS

CN 103707944 A 4/2014
CN 203902565 U 10/2014
(Continued)

*Primary Examiner* — S. Joseph Morano
*Assistant Examiner* — Cheng Lin
(74) *Attorney, Agent, or Firm* — Cantor Colburn LLP

(57) ABSTRACT

Some embodiments of the present disclosure provide a chassis component of a railway vehicle, and a railway vehicle. The chassis component includes two lower boundary beams provided at an interval and a sleeper beam provided between the two lower boundary beams. The sleeper beam includes: a web structure; a center pin, connected with a bogie of a railway vehicle; and a mounting frame, connected with the web structure, the center pin being provided on the mounting frame, the mounting frame including a plurality of vertical plates, and the plurality of vertical plates being provided at an interval along an outer wall surface of the center pin. The technical solution of the present disclosure can solve the problem in the related art of insufficient connecting strength of a center pin and a web structure of a sleeper beam.

20 Claims, 17 Drawing Sheets

(51) Int. Cl.

| | |
|---|---|
| ***B61F 1/14*** | (2006.01) |
| ***B61D 17/10*** | (2006.01) |
| ***B61F 1/00*** | (2006.01) |
| ***B61F 1/08*** | (2006.01) |
| *B61F 1/02* | (2006.01) |

(52) U.S. Cl.
CPC ..... *B61F 1/08* (2013.01); *B61F 1/14* (2013.01); *B61F 1/02* (2013.01)

(58) Field of Classification Search
CPC ..... B61F 5/16; B61F 1/14; B61F 5/18; B61F 5/52; B61F 5/50; B61D 15/06; B61D 17/08; B61D 17/10; B61D 17/04; B61D 17/00
USPC ..... 105/25.01, 418
See application file for complete search history.

(56) References Cited

U.S. PATENT DOCUMENTS

| | | | | | |
|---|---|---|---|---|---|
| 3,770,139 | A | | 11/1973 | Glenn | |
| 3,859,928 | A | * | 1/1975 | Adler | B61F 5/18 105/199.4 |
| 4,589,348 | A | * | 5/1986 | Holabeck | B61F 5/16 105/199.4 |
| 5,465,670 | A | * | 11/1995 | Butcher | B61D 3/20 105/355 |
| 6,324,995 | B1 | * | 12/2001 | Kaufhold | B61F 5/16 105/199.4 |
| 10,029,709 | B2 | * | 7/2018 | Tateishi | B61D 17/10 |
| 10,730,145 | B2 | * | 8/2020 | Han | B23K 31/125 |
| 2015/0367863 | A1 | * | 12/2015 | Hirashima | B61D 17/08 105/422 |

FOREIGN PATENT DOCUMENTS

| | | | | |
|---|---|---|---|---|
| CN | 106184263 | A | | 12/2016 |
| CN | 107628050 | A | * | 1/2018 |
| CN | 107628050 | A | | 1/2018 |
| JP | 201787800 | A | | 5/2017 |

* cited by examiner

CHASSIS COMPONENT OF RAILWAY VEHICLE, AND RAILWAY VEHICLE

CROSS REFERENCE TO RELATED APPLICATION

This application is related to and claims the benefit of Chinese Patent Application Number 201811038248.1 filed on Sep. 6, 2018, the contents of which are herein incorporated by reference in their entirety.

TECHNICAL FIELD

The present disclosure relates to a technical field of railway vehicles, and in particular to a chassis component of a railway vehicle, and a railway vehicle.

BACKGROUND

A sleeper beam not only is a connecting part of a vehicle body and a bogie of the railway vehicle, but also is a main bearing part of a chassis component, which is used for transferring force and torque transferred from the bogie to the vehicle body.

A center pin of a traditional railway vehicle is provided on the bogie, and the center pin is in threaded connection with the sleeper beam through a screw. The sleeper beam in the related art includes two structural forms: a simple I-shaped structure and an overall box-type structure. In the above two sleeper beam structures, the sleeper beam having the I-shaped structure is low in strength, and cannot meet requirements for vehicle body load; the sleeper beam having the box-type structure is in threaded connection with the center pin on the bogie through a screw, the connecting strength between the center pin and the sleeper beam is insufficient, and during the long-term operation process of the railway vehicle, it is difficult to ensure the stability of a connecting structure due to the reasons such as vibration of the vehicle, so that the transfer of force and torque of the entire vehicle is affected.

SUMMARY

Some embodiments of the present disclosure provide a chassis component of a railway vehicle and a railway vehicle, intend to solve the problem in the related art.

Some embodiments of the present disclosure provide a chassis component of a railway vehicle. The chassis component includes two lower boundary beams provided at an interval and a sleeper beam provided between the two lower boundary beams. The sleeper beam includes: a web structure; a center pin, connected with a bogie of a railway vehicle; and a mounting frame, connected with the web structure, the center pin being provided on the mounting frame, the mounting frame including a plurality of vertical plates, and the plurality of vertical plates being provided at an interval along an outer wall surface of the center pin.

Some embodiments of the present disclosure provide a railway vehicle. The railway vehicle includes a vehicle body structure and a chassis component connected with the vehicle body structure, the chassis component being the above chassis component.

By applying the embodiments of the present disclosure, since the plurality of vertical plates are provided on the outer wall surface of the center pin to form the mounting frame, the connecting area between the center pin and the web structure is increased, thus improving the connecting strength between the center pin and the web structure. Compared with the screw-based threaded connection between the center pin provided on the bogie and the sleeper beam in the related art, in an embodiment of the present disclosure, the mounting frame is additionally provided to connect the center pin and the web structure of the sleeper beam, the plurality of vertical plates are used to increase the connecting strength between the mounting frame and the center pin, and then the mounting frame provided with the center pin is connected with the web structure, so that the connecting strength between the center pin and the web structure is improved, thus improving the overall strength of the sleeper beam, ensuring that the center pin can stably transfer force and torque from the bogie during the operation process of the railway vehicle, and guaranteeing the normal operation of the railway vehicle.

BRIEF DESCRIPTION OF THE DRAWINGS

The accompanying drawings, which constitute a part of the present application, are used to provide a further understanding of the present disclosure, and the exemplary embodiments of the present disclosure and the description thereof are used to explain the present disclosure, but do not constitute improper limitations to the present disclosure. In the drawings.

The drawings include the following reference signs:

10: sleeper beam; 11: center pin; 12: vertical plate; 13: rib plate; 131: bulge; 132: weight-reducing through hole; 14: web structure; 141: web; 142: wire passage hole; 15: upper cover plate; 151: through hole; 152: first penetration-out hole; 16: lower cover plate; 161: second penetration-out hole; 17: inner boundary beam;

20: lower boundary beam; 201: first flat plate; 202: vertical plate; 203: second flat plate; 21: connecting seat; 211: first connecting plate; 212: second connecting plate; 213: third connecting plate; 214: weight-reducing hole; 22: pipe passage structure; 23: first reinforcing member; 231: first reinforcing plate; 232: second reinforcing plate; 24: ventilation opening; 25: supporting seat; 251: first edge plate; 252: second edge plate; 253: third edge plate; 26: drain hole; 27: corner post mounting hole; 28: second reinforcing member;

30: middle beam; 31: first horizontal segment; 311: bending portion; 32: vertical segment; 33: second horizontal segment; 34: reinforcing member; 341: first reinforcing structure; 342: second reinforcing structure; 35: cover plate; 351: first cover plate; 352: second cover plate; 353: reinforcing rib;

40: cross beam component; 41: first cross beam; 411: U-shaped beam; 412: connecting beam; 42: second cross beam; 421: hooking portion; 422: first horizontal beam; 423: vertical beam; 424: second horizontal beam; 425: wire passage groove; 43: floor.

DETAILED DESCRIPTION OF THE EMBODIMENTS

It is to be noted that in the case of no conflict, the features in the embodiments and the embodiments in the present application may be combined with each other. The present disclosure is described below with reference to the drawings and in conjunction with the embodiments in detail.

Figure 1:
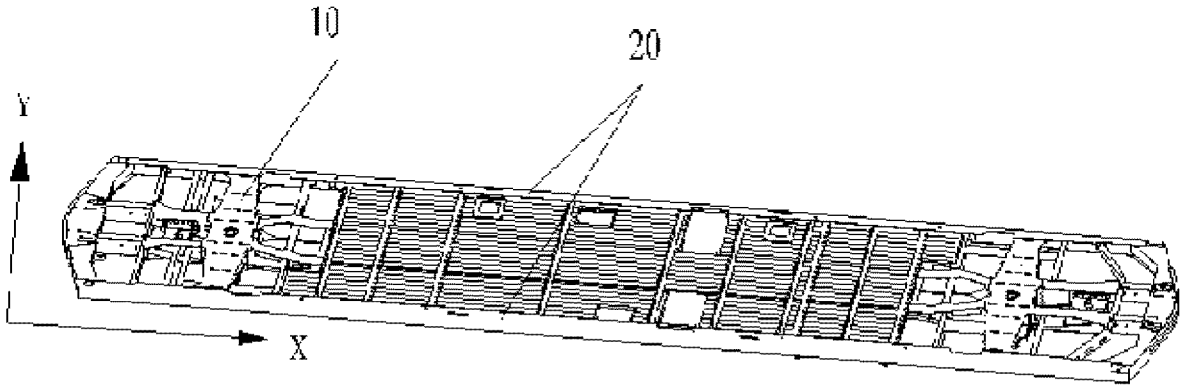
FIG. 1 illustrates a first structural schematic diagram of a chassis component of a railway vehicle according to an embodiment of the present disclosure.

In the present disclosure and the embodiments of the present disclosure, as shown in FIG. 1, a length direction of a chassis component is an X direction, and a width direction of the chassis component is a Y direction.

Figure 3:
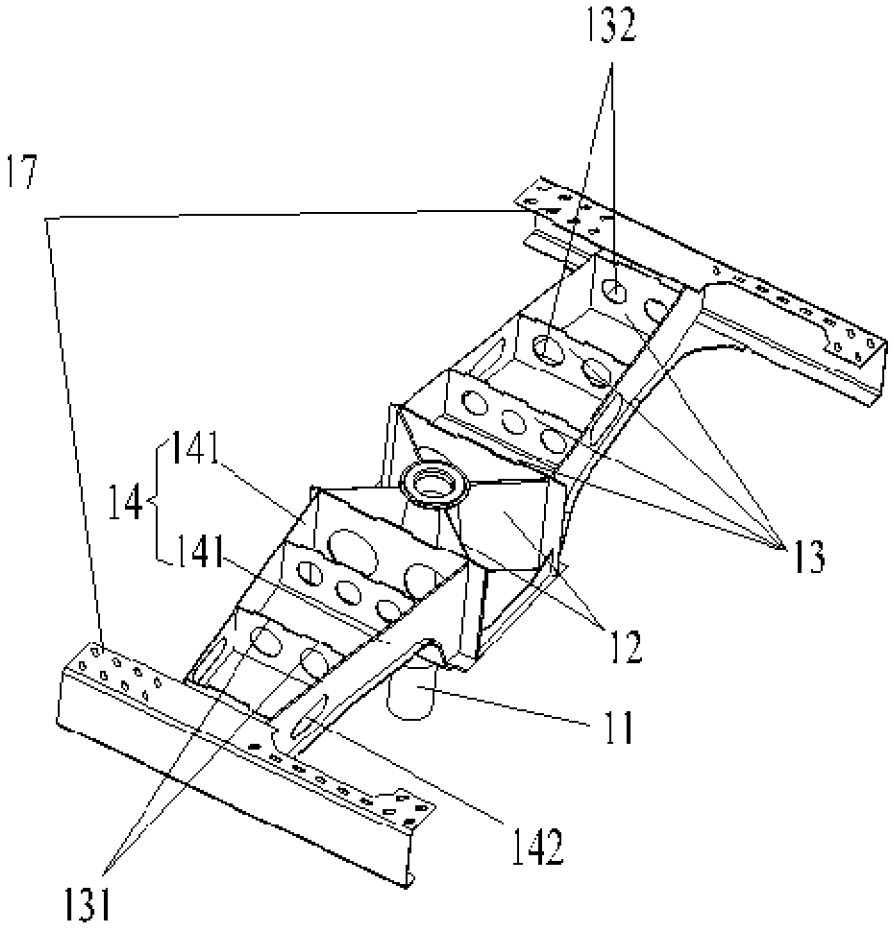
FIG. 3 illustrates a partial structural schematic diagram of the sleeper beam in FIG. 2 (where an upper cover plate is removed)

As shown in FIG. 1 and FIG. 3, an embodiment of the present disclosure provides a chassis component of a railway vehicle. The chassis component of the present embodiment includes two lower boundary beams 20 provided at an interval and a sleeper beam 10 provided between the two lower boundary beams 20. The sleeper beam 10 includes a web structure 14, a center pin 11 and a mounting frame. The center pin 11 is connected with a bogie of a railway vehicle, the mounting frame is connected with the web structure 14, the center pin 11 is provided on the mounting frame, the mounting frame includes a plurality of vertical plates 12, and the plurality of vertical plates 12 are provided at an interval along an outer wall surface of the center pin 11.

In the present embodiment, the plurality of vertical plates 12 are provided on the outer wall surface of the center pin 11 to form the mounting frame, so that the connecting area between the center pin 11 and the web structure 14 is increased, thus improving the connecting strength between the center pin 11 and the web structure 14. Compared with the screw-based threaded connection between the center pin provided on the bogie and the sleeper beam in the related art, in an embodiment of the present disclosure, the mounting frame is additionally provided to connect the center pin 11 and the web structure 14 of the sleeper beam 10, the plurality of vertical plates 12 are used to increase the connecting strength between the mounting frame and the center pin 11, and then the mounting frame provided with the center pin 11 is connected with the web structure 14, so that the connecting strength between the center pin 11 and the web structure 14 is improved, thus improving the overall strength of the sleeper beam 10, ensuring that the center pin 11 can stably transfer force and torque from the bogie during the operation process of the railway vehicle, and guaranteeing the normal operation of the railway vehicle.

A joint between the sleeper beam 10 and the center pin 11 on the chassis component of the railway vehicle is a stress concentration area on the chassis component. During an operation process of the railway vehicle, it is necessary to ensure the connecting strength between the center pin 11 and the sleeper beam 10, so as to ensure that the center pin 11 can stably transfer force and torque from the bogie. Therefore, the center pin 11 in an embodiment of the present disclosure is connected with the web structure 14 of the sleeper beam 10 through the mounting frame, the connecting strength is good, the connection is firm, and the normal operation of the railway vehicle is ensured.

As shown in FIG. 3, in an exemplary embodiment of the present disclosure, the plurality of vertical plates 12 are provided on the outer wall surface of the center pin 11 in an X shape, each of the plurality of vertical plates 12 is welded to the outer wall surface of the center pin 11.

In an exemplary embodiment of the present disclosure, the mounting frame is composed of four vertical plates 12, the four vertical plates 12 are provided on the outer wall surface of the center pin 11 in an X shape. The arrangement improves the strength of the mounting frame, and the four vertical plates 12 simultaneously support the center pin 11, thereby improving the connecting strength between the center pin 11 and the mounting frame. Thus, when the mounting frame provided with the center pin 11 is subsequently assembled to the web structure 14, the center pin 11 is not easily separated from the mounting frame, and can be better connected with the bogie.

In an exemplary embodiment, the four vertical plates 12 are welded to the outer wall surface of the center pin 11 respectively, and compared with bolt connection between the center pin and the sleeper beam in the related art, the connecting mode of the embodiment is firmer. The four vertical plates 12 and the center pin 11 are welded to form a whole, thereby ensuring the overall strength of the sleeper beam 10.

Of course, in an alternative embodiment not illustrated in the drawings of the present disclosure, the number of vertical plates 12 of the mounting frame is not limited to 4, and can be appropriately set according to the internal space of the sleeper beam 10.

As shown in FIG. 3, in an exemplary embodiment of the present disclosure, the sleeper beam 10 includes two web structures 14, the mounting frame are located between the two web structures 14.

In the embodiment of the present application, the mounting frame is located between the two web structures 14, and the mounting frame is connected with the two web structures 14 respectively, so that two ends of the mounting frame are fixed, and the stability of the mounting frame is improved, thus ensuring the stability of connection between the center pin 11 and the web structure 14 of the sleeper beam 10.

As shown in FIG. 3, in an exemplary embodiment of the present disclosure, the sleeper beam 10 further includes a plurality of rib plates 13, each of the two web structures 14 includes two spaced webs 141, and the plurality of rib plates 13 are provided between the two webs 141 at an interval.

In an exemplary embodiment, there is an included angle between the two webs 141 of the web structure 14, and spacing between the two webs 141 is gradually reduced along a direction away from the mounting frame.

A plurality of rib plates 13 are provided between the two webs 141, and in an exemplary embodiment, the plurality of rib plates 13 are provided between the two webs 141 in parallel. The arrangement improves the structural strength of the sleeper beam 10, and the plurality of rib plates 13 can effectively share the action force transferred to the sleeper beam 10, thereby improving the bearing capacity of the sleeper beam 10.

Of course, in an alternative embodiment not illustrated in the drawings of the present disclosure, the plurality of rib plates 13 may form an included angle between the two webs 141, and a specific arrangement mode may be selected according to the bearing situation of the sleeper beam 10.

As shown in FIG. 3, in an exemplary embodiment of the present disclosure, the each of the two web structures 14 is connected with at least one of the plurality of vertical plates 12 of the mounting frame through at least one of the plurality of rib plates 13.

In an exemplary embodiment, each of the two web structures 14 is connected with the two vertical plates 12 of the mounting frame through the outermost rib plate 13, that is, the rib plate 13 in the plurality of rib plates closest to the mounting frame is connected with the two vertical plates 12, and the rib plate 13 in the plurality of rib plates is connected with the two webs 141 of the corresponding web structure 14.

In some embodiments, the mounting frame is connected with the web structure 14 through the rib plate 13. Compared with direct connection between the mounting frame and the web structure 14, the arrangement mode of the present application converts line-to-line connection between the mounting frame and the web structure 14 into line-to-surface connection between the vertical plate 12 and the rib plate 13 and line-to-surface connection between the web 141 and the rib plate 13, so that the connecting strength between the mounting frame and the web structure 14 is improved, and the stability of connection between the mounting frame and the web structure 14 is ensured, thus ensuring the stability of connection between the center pin 11 and the web structure 14.

As shown in FIG. 3, in an exemplary embodiment of the present disclosure, at least one rib plate 13 in the plurality of rib plates 13 is provided with a weight-reducing through hole 132.

In an exemplary embodiment, each of the plurality of rib plates 13 is provided with a weight-reducing through hole 132.

On the premise of ensuring that the rib plate 13 can improve the strength of the sleeper beam 10, the weight of the rib plate 13 is reduced, thus realizing the light weight of the sleeper beam 10, and reducing the weight of the chassis component. Further, by providing the weight-reducing through hole 132, the transfer of the impact force can be stopped when the vehicle body is impacted, thereby avoiding damage to a rear end of the vehicle body caused by the impact force, and improving the safety of the vehicle body.

Of course, in an alternative embodiment not illustrated in the drawings of the present disclosure, the size of the rib plate 13 may be designed as required, and the weight-reducing through hole 132 may also be provided on a part of the plurality of rib plates 13, so as to ensure the strength of the sleeper beam 10 and reduce the weight of the sleeper beam 10.

Figure 4:
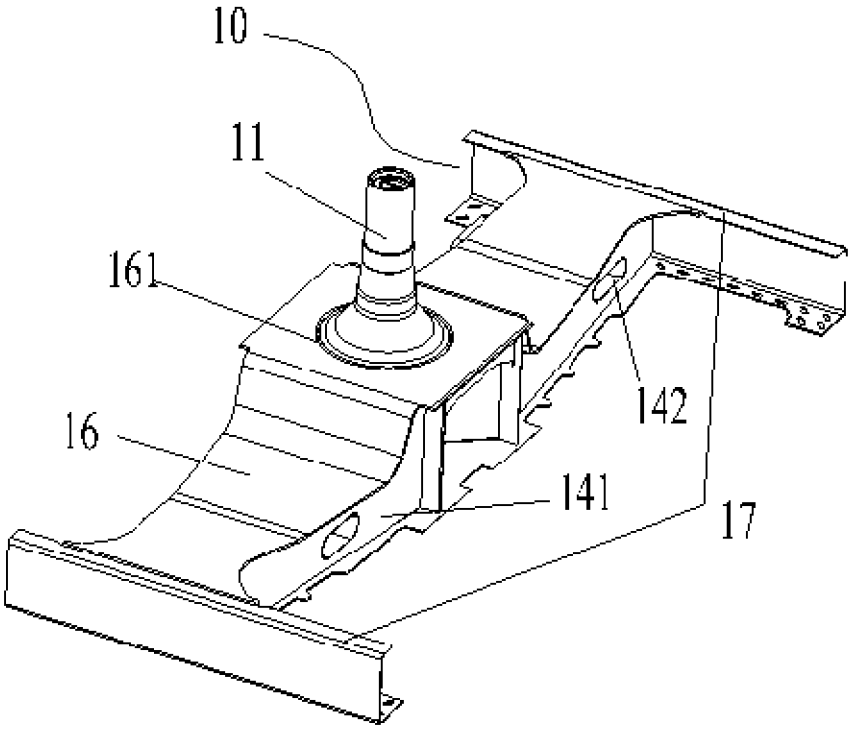
FIG. 4 illustrates a structural schematic diagram of the sleeper beam in FIG. 2 in another direction.

As shown in FIG. 3 and FIG. 4, in an exemplary embodiment of the present disclosure, each web 141 is provided with a wire passage hole 142.

A wire harness may pass through the chassis component of the railway vehicle, and in order to facilitate the connection and penetration of the wire harness, a wire passage hole 142 is provided on the web 141 for the penetration out or in of the wire harness.

In an exemplary embodiment of the present disclosure, the wire passage holes 142 on the two webs 141 of the web structure 14 are correspondingly provided to facilitate the penetration of the wire harness. In an exemplary embodiment, a pipeline for wire passage may penetrate into the wire passage hole 142, so that the wire harness penetrates into the pipeline for the storage of the wire harness, thereby avoiding damage to the wire harness caused by wire harness exposure.

Figure 2:
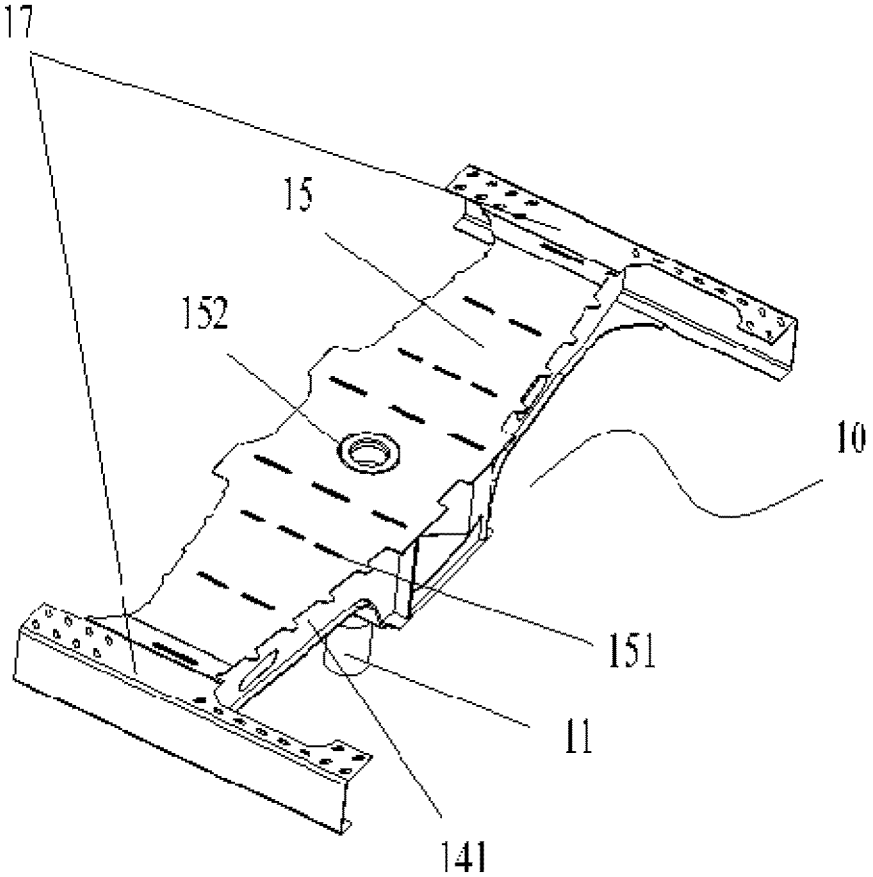
FIG. 2 illustrates a structural schematic diagram of a sleeper beam of the chassis component in FIG. 1.

As shown in FIG. 2, in an exemplary embodiment of the present disclosure, the sleeper beam 10 further includes an upper cover plate 15 covering the two webs 141, the upper cover plate 15 is provided with a plurality of through holes 151, at least one of the rib plates 13 is provided with a bulge 131, and the bulge 131 matches a corresponding through hole 151 in the plurality of through holes 151.

Figure 5:
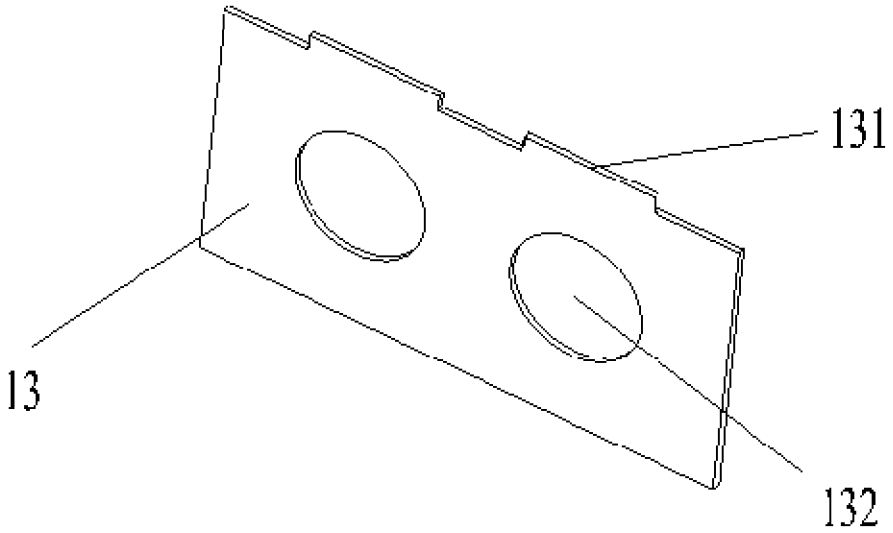
FIG. 5 illustrates a structural schematic diagram of a rib plate of the sleeper beam in FIG. 2.

In an exemplary embodiment, as shown in FIG. 5, each rib plate 13 is provided with a bulge 131, and the upper cover plate 15 is provided with a plurality of through holes 151 in one-to-one correspondence with the plurality of bulges 131. By means of the arrangement, after the upper cover plate 15 covers the webs 141, the bulges 131 on the rib plate 13 are in inserted fit with the through holes 151 on the upper cover plate 15, so as to connect the upper cover plate 15 and the rib plate 13 together. Thus, the upper cover plate 15 covers a cavity enclosed by the web structure 14 and the rib plate 13, so as to form a box structure of the sleeper beam 10.

In an exemplary embodiment, in order to ensure the connecting strength between the upper cover plate 15 and the rib plates 13, after the bulges 131 are in inserted fit with the through holes 151, the fit part is welded, so as to further ensure the connecting strength between the upper cover plate 15 and the rib plates 13, thereby ensuring the overall strength of the sleeper beam 10.

As shown in FIG. 2, in an exemplary embodiment of the present disclosure, the upper cover plate 15 is provided with a first penetration-out hole 152, one end of the center pin 11 penetrating out of the first penetration-out hole 152.

The arrangement ensures the fit between the center pin 11 and the upper cover plate 15, the first penetration-out hole 152 limits the center pin 11, and it is ensured that the center pin 11 is pivoted to the bogie provided at the lower part of the chassis component.

As shown in FIG. 4, in an exemplary embodiment of the present disclosure, the sleeper beam 10 further includes a lower cover plate 16 disposed at a lower part of each of the webs 141, the lower cover plate 16 is fixedly connected with each rib plate 13.

In the present application, the upper cover plate 15 corresponds to the lower cover plate 16, and the upper cover plate 15, the lower cover plate 16 and the web structure 14 jointly enclose a box structure. Further, the lower cover plate 16 is fixedly connected with each of the plurality of rib plates 13, thereby ensuring the stability of connection between the rib plate 13 and the lower cover plate 16.

In an exemplary embodiment, each web 141 is welded to the lower cover plate 16, the rib plate 13 is welded to the web 141, and after the upper cover plate 15 is in inserted fit with each rib plate 13, welding fixing is performed. The embodiment makes the sleeper beam 10 forms a stable whole, and ensures the overall strength of the sleeper beam 10.

In an exemplary embodiment, as shown in FIG. 4, the upper cover plate 16 is provided with a second penetration-out hole 161, the other end of the center pin 11 penetrating out of the second penetration-out hole 161.

The arrangement ensures the connection between the center pin 11 and the bogie provided at the lower part of the chassis component, thus ensuring that the sleeper beam 10 may transfer force and torque transferred from the bogie to the vehicle body.

As shown in FIG. 1 and FIG. 2, in an exemplary embodiment of the present disclosure, the sleeper beam 10 further includes two inner boundary beams 17, the two inner boundary beams 17 are provided at an interval and are in one-to-one corresponding connection with the two lower boundary beams 20.

In a width direction of the chassis component, the two inner boundary beams 17 are spaced at two ends of the sleeper beam 10. Moreover, the two inner boundary beams 17 are in one-to-one corresponding connection with the two lower boundary beams 20 respectively so as to connect the sleeper beam 10 and the lower boundary beam 20.

In an exemplary embodiment, the inner boundary beam 17 is welded to the corresponding lower boundary beam 20, thereby ensuring the connecting strength between the sleeper beam 10 and the lower boundary beam 20.

As shown in FIG. 3, in an exemplary embodiment of the present disclosure, each of the two inner boundary beams 17 is connected with two webs 141 of at least one web structure 14.

In an exemplary embodiment the present disclosure, the sleeper beam 10 includes two web structures 14, the two web structures 14 are located on two sides of the mounting frame respectively. The inner boundary beams 17 located on the same side of the mounting frame are welded to the two webs 141 of the web structure 14 respectively.

The arrangement forms a complete cavity inside the sleeper beam 10, and the web 141 is welded to the inner boundary beam 17, thus ensuring the overall strength of the sleeper beam 10.

Figure 6:
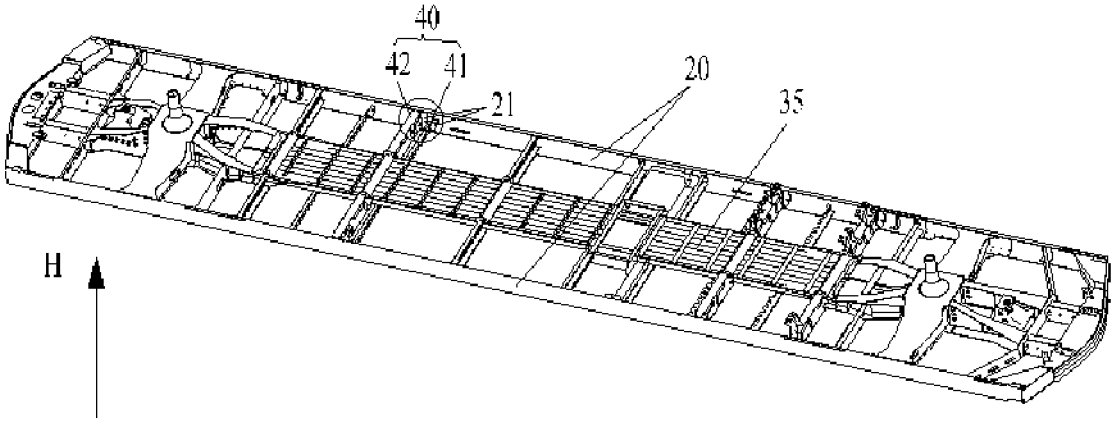
FIG. 6 illustrates a stereo-structure schematic diagram of a chassis component of a railway vehicle according to an embodiment of the present disclosure.
Figure 7:
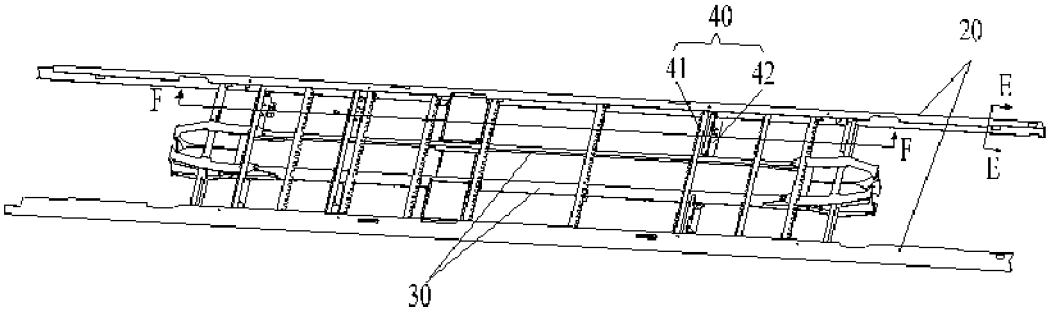
FIG. 7 illustrates an H-direction structural schematic diagram of the chassis component in FIG. 6 (where a lower boundary beam, a cross beam and a middle beam are illustrated)

As shown in FIG. 6 and FIG. 7, an embodiment of the present disclosure provides a chassis component of a railway vehicle. The chassis component of the present embodiment further includes two lower boundary beams 20 provided at an interval and a plurality of cross beam components 40 provided between the two lower boundary beams 20, the plurality of cross beam components 40 are provided at an interval along a length direction of each of the two lower boundary beams 20, at least one of the two lower boundary beams 20 is provided with a connecting seat 21, and at least one end of each of the plurality of cross beam components 40 is connected with a corresponding lower boundary beam 20 in the two lower boundary beam 20 through the connecting seat 21.

In an exemplary embodiment, the connecting seat 21 is in surface-to-surface contact with the corresponding cross beam component 40, and the connecting seat 21 is in surface-to-surface contact with the corresponding lower boundary beam 20. Thus, a connecting relationship between the cross beam component 40 and the lower boundary beam 20 is converted into connection between the cross beam component 40 and the connecting seat 21 and connection between the connecting seat 21 and the lower boundary beam 20, and a line-to-surface contact between the cross beam component 40 and the lower boundary beam 20 in the related art is converted into a surface-to-surface contact through the connecting seat 21, thereby improving the connecting strength between the cross beam component 40 and the lower boundary beam 20, and ensuring the strength and rigidity requirements for the chassis component. Further, compared with a line-to-surface contact achieved by welding or clamping between the cross beam component 40 and the lower boundary beam 20 in the related art, the surface-to-surface contact in the present embodiment more facilitates connection, facilitates assembly of the chassis component by an operator, and improves the assembly efficiency.

As shown in FIG. 8 to FIG. 11, in an exemplary embodiment of the present disclosure, the lower boundary beam 20 includes a first flat plate 201, a vertical plate 202 and a second flat plate 203 connected in sequence, and the connecting seat 21 includes a first connecting plate 211, a second connecting plate 212 and a third connecting plate 213. The first connecting plate 211 is connected with the vertical plate 202; the second connecting plate 212 forms an included angle with the first connecting plate 211, and the second connecting plate 212 is connected with a corresponding cross beam component 40 in the plurality of cross beam components 40; and there is an included angle between the third connecting plate 213 and the first connecting plate 211, there is an included angle between the third connecting plate 213 and the second connecting plate 212 respectively, the third connecting plate 213 is connected with the first flat plate 201 or the second flat plate 203.

In an exemplary embodiment of the present disclosure, the connecting seat 21 is composed of three connecting plates, any two connecting plates are vertically connected, the connection between the cross beam component 40 and the lower boundary beam 20 is converted into the connection between the cross beam component 40 and the connecting seat 21 and the connection between the connecting seat 21 and the lower boundary beam 20 by providing the connecting seat 21. Thus, a line connection or a point connection between the cross beam component 40 and the lower boundary beam 20 in the related art is converted into a surface connection between the cross beam component 40 and the connecting seat 21 and a surface connection between the connecting seat 21 and the lower boundary beam 20. Therefore, the arrangement improves the connecting strength of the cross beam component 40 connected with the lower boundary beam 20, and ensures the rigidity requirements for the chassis component of the railway vehicle.

In an exemplary embodiment of the present disclosure, when the connecting seat 21 is used for connecting the first cross beam 41 and the lower boundary beam 20, the first connecting plate 211 is welded to the vertical plate 202, and the third connecting plate 213 is welded to the first flat plate 201; and when the connecting seat 21 is used for connecting the second cross beam 42 and the lower boundary beam 20, the first connecting plate 211 is welded to the vertical plate 202, and the third connecting plate 213 is welded to the second flat plate 203.

In the arrangement, the welding mode is simpler and high in strength, and ensures the connecting strength between the connecting seat 21 and the lower boundary beam 20.

In an exemplary embodiment of the present disclosure, the second connecting plate 212 is welded to the cross beam component 40.

The embodiment ensures the connecting strength between the cross beam component 40 and the connecting seat 21, and the connecting seat 21 is also connected with the lower boundary beam 20 in a welding mode, thus ensuring the connecting strength between the cross beam component 40 and the lower boundary beam 20, and meeting the strength and rigidity requirements for the chassis component.

In an exemplary embodiment of the present disclosure, the first connecting plate 211, the second connecting plate 212 and the third connecting plate 213 are of an integrated forming structure, and the arrangement ensures the strength of the connecting seat 21.

Figure 9:
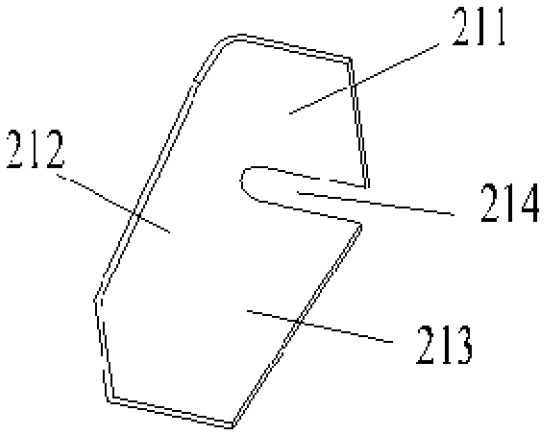
FIG. 9 illustrates a structural schematic diagram of a connecting seat of the chassis component in FIG. 6.

As shown in FIG. 9, in an exemplary embodiment of the present disclosure, the connecting seat 21 is further provided with a weight-reducing hole 214. The provision of the weight-reducing hole 214 reduces the weight of the chassis component, and facilitates forming of the connecting seat 21.

As shown in FIG. 6 and FIG. 7, in an exemplary embodiment of the present disclosure, at least one cross beam component 40 in the plurality of cross beam components 40 includes a first cross beam 41 and a second cross beam 42. Two opposite ends of the first cross beam 41 are correspondingly connected with the two lower boundary beams 20, and the second cross beam 42 and the first cross beam 41 are correspondingly provided in a height direction of each of the two lower boundary beams 20.

Figure 10:
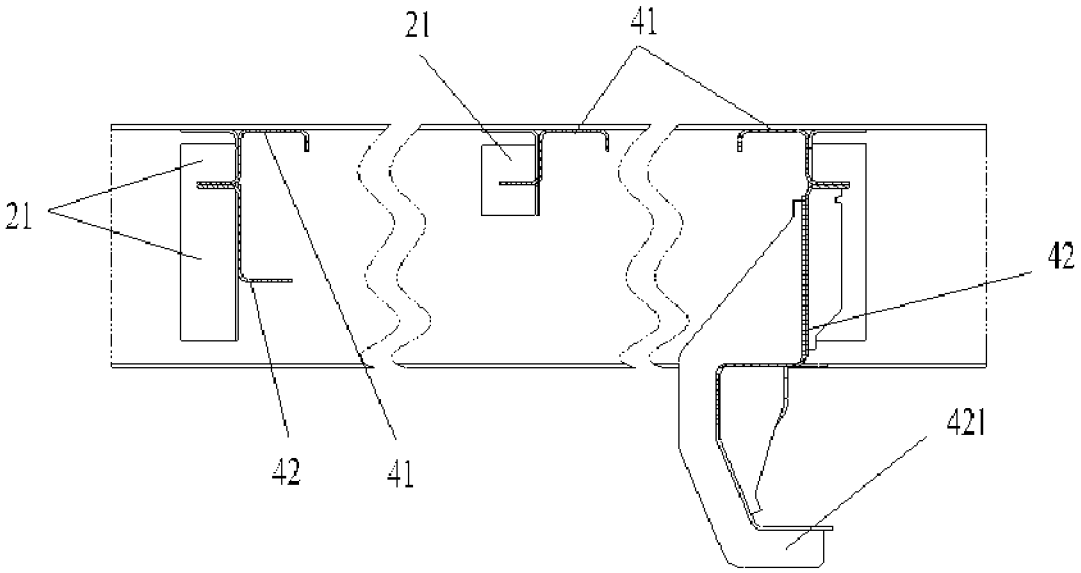
FIG. 10 illustrates an F-F direction sectional view in FIG. 7.
Figure 11:
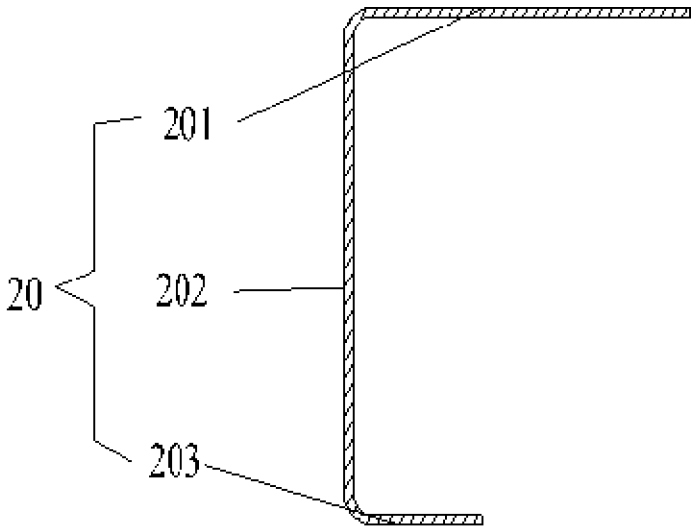
FIG. 11 illustrates an E-E sectional view in FIG. 7.

In an exemplary embodiment of the present disclosure, as shown in FIG. 10, the first cross beam 41 and the second cross beam 42 are correspondingly provided in the height direction of the lower boundary beam 20, and the second cross beam 42 is provided below the first cross beam 41.

In an exemplary embodiment of the present disclosure, a plurality of first cross beams 41 and a plurality of second cross beams 42 are provided between the two lower boundary beams 20 in the length direction of the chassis component. Optionally, the length of the first cross beam 41 is equal to a distance between the two opposite lower boundary beams 20.

In the present embodiment, the cross beam component 40 is set as a matching structure of the first cross beam 41 and the second cross beam 42, the plurality of first cross beams 41 having the same structure and the plurality of second cross beams 42 having the same structure are processed during the production, and then the first cross beams 41 and the second cross beams 42 are assembled according to the structure requirements of the chassis component, thereby implementing the modularization of the assembly process, and improving the production efficiency.

Figure 8:
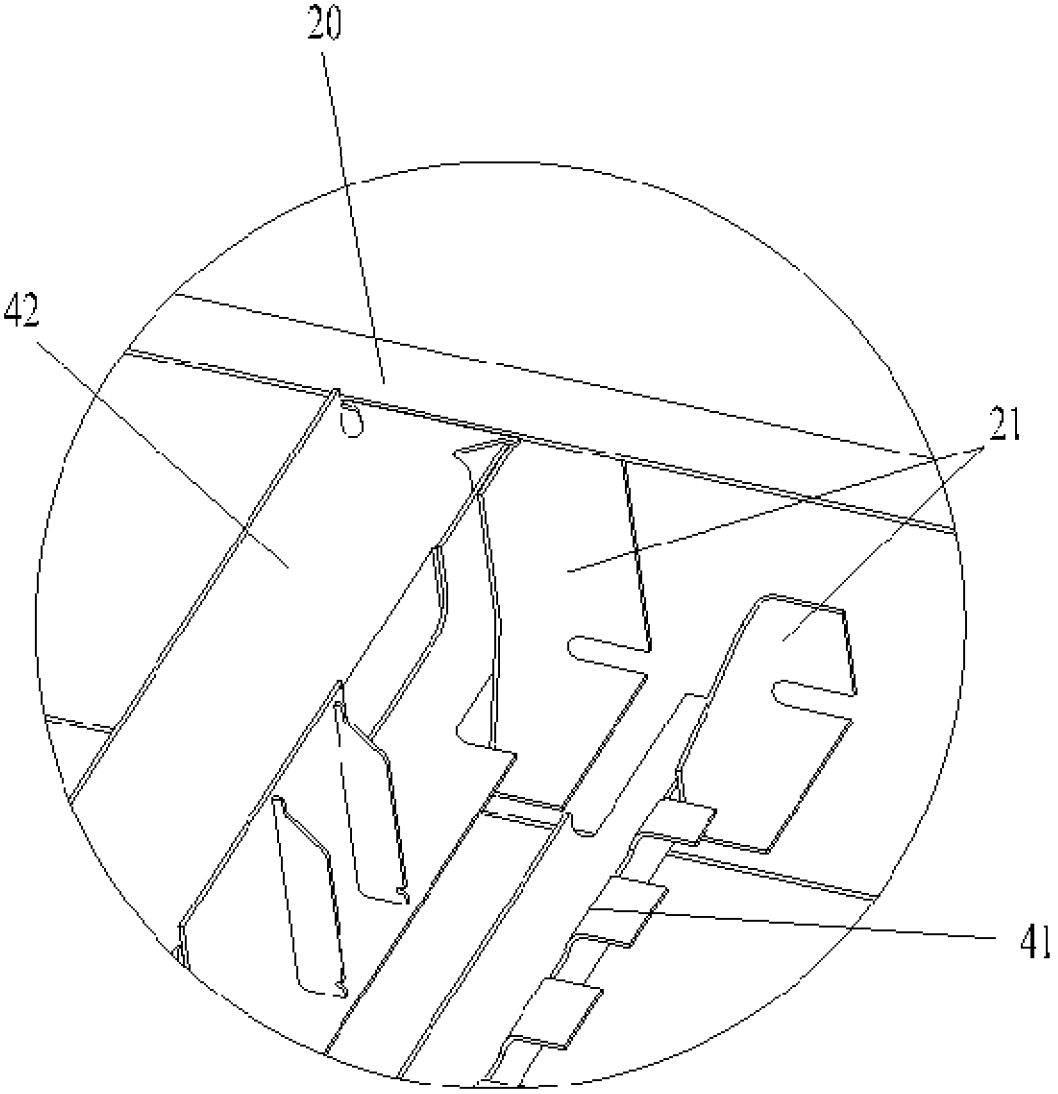
FIG. 8 illustrates a partial enlarged schematic diagram of FIG. 6.

As shown in FIG. 6 and FIG. 8, in an exemplary embodiment of the present disclosure, at least one lower boundary beam 20 is provided with two connecting seats 21, and the first cross beam 41 and the second cross beam 42 are connected with the lower boundary beam 20 through the corresponding connecting seats 21, respectively.

In the embodiment of the present disclosure, the first cross beam 41 and the second cross beam 42 are connected with the lower boundary beam 20 through the connecting seats 21, respectively.

In an exemplary embodiment, the size of the connecting seat 21 may be adjusted according to the cross section sizes of the first cross beam 41 and the second cross beam 42, so as to match the cross section size of the first cross beam 41 or the second cross beam 42.

As shown in FIG. 6, in an exemplary embodiment of the present disclosure, the second cross beam 42 includes a plurality of cross beam segments connected in sequence, at least one of the plurality of cross beam segments is connected with one of the two lower boundary beams 20, and at least another of the plurality of cross beam segments is connected with the other one of the two lower boundary beams 20.

In an exemplary embodiment, the second cross beam 42 includes three cross beam segments connected in sequence. One end of one outermost cross beam segment is connected with one of the lower boundary beams 20 through the connecting seat 21, and the other end is connected with the cross beam segment in the middle of the second cross beam 42. One end of the other outermost cross beam segment is connected with the other lower boundary beam 20 through the connecting seat 21. Therefore, the two outermost cross beam segments in the three cross beam segments are correspondingly connected with the two lower boundary beams 20, and the cross beam segment in the middle is connected with the cross beam segments at two ends.

As shown in FIG. 10, in an exemplary embodiment of the present disclosure, the chassis component includes a plurality of second cross beams 42, one side, away from the first cross beam 41, of at least one second cross beam 42 is provided with a hooking portion 421.

In an embodiment of the present disclosure, since a device at the bottom of the chassis component cannot be welded to the chassis component, the chassis component can be hooked to the bottom device by providing the hooking portion 421, so that the connection requirements are met.

In an exemplary embodiment, the hooking portion 421 and the second cross beam 42 are of an integrated forming structure.

As shown in FIG. 6 and FIG. 7, in an exemplary embodiment of the present disclosure, the chassis component further includes a middle beam 30 provided between the two lower boundary beams 20, the middle beam 30 extending along the length direction of at least one of the two lower boundary beams 20.

In an exemplary embodiment, the chassis component includes two middle beams 30 provided at an interval, the two middle beams 30 extend along the length direction of the lower boundary beam 20, and the two middle beams 30 are matched with the lower boundary beam 20, so as to meet the strength requirements in the length direction of the chassis component.

Of course, in an alternative embodiment not illustrated in the drawings of the present disclosure, the number of the middle beams 30 is not limited to two, and can be set according to the space of the chassis component and the strength and rigidity requirements.

In an exemplary embodiment of the present disclosure, as shown in FIG. 6 and FIG. 7, there is an included angle between the middle beam 30 and each of the cross beam components 40.

In an exemplary embodiment, each of the cross beam components 40 is vertical to the middle beam 30, and each of the cross beam components 40 is also vertical to the two lower boundary beams 20. The arrangement makes the chassis component form a structure similar to a grid, thus improving the strength and rigidity of the chassis component, and ensuring the mounting and normal operation of the device on the chassis component.

As shown in FIG. 6, in an exemplary embodiment of the present disclosure, the chassis component further includes a cover plate 35 provided on the middle beam 30, a ventilation air duct is formed between the cover plate 35 and the middle beam 30.

In an exemplary embodiment, the ventilation air duct is provided on the chassis component, and the ventilation air duct is provided with an air supply opening and an air outlet communicated with an in-vehicle environment. The cover plate 35 matches the middle beam 30 to form the ventilation air duct, thus forming a longitudinal beam along the length direction of the chassis component. The longitudinal beam and the lower boundary beam 20 cooperatively share the weight of a vehicle body structure and an apparatus in the vehicle, thereby improving the bearing capacity of the railway vehicle.

In an exemplary embodiment, at least one cross beam component 40 in the plurality of cross beam components 40 only includes a first cross beam 41. The second cross beam 42 in the present application supports the cover plate 35, a person skilled in the art may appropriately set the number of second cross beams 42 as required, on the premise of ensuring the strength of the chassis component, the number of the second cross beams 42 may be appropriately reduced, and the second cross beams do not need to be in one-to-one correspondence with the first cross beams 41. The reduction of the number of the second cross beams 42 can reduce the weight of the chassis component, thereby achieving the effect of light weight.

Figure 12:
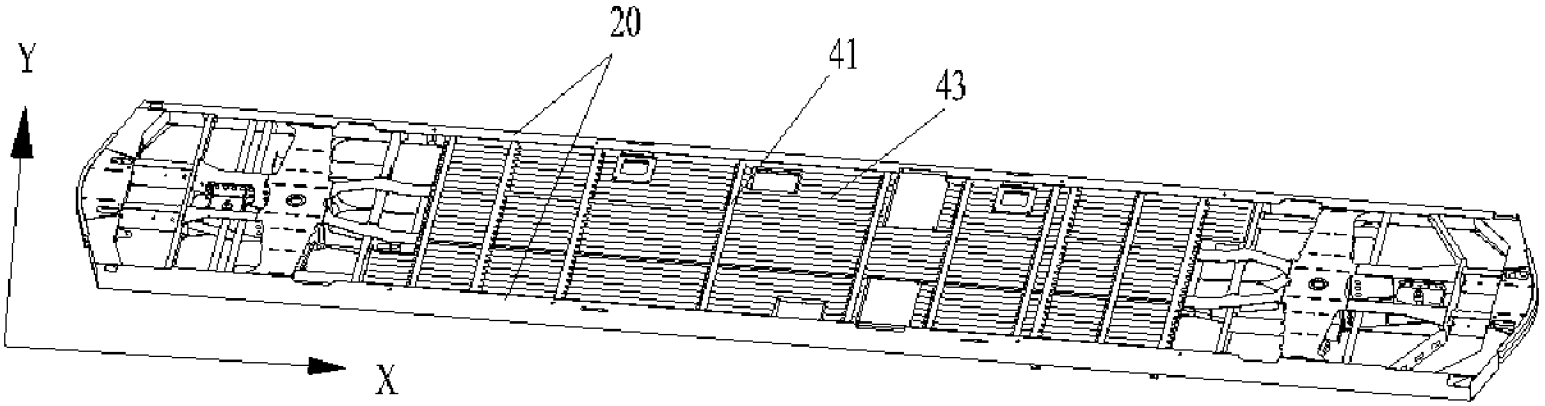
FIG. 12 illustrates a second structural schematic diagram of a chassis component of a railway vehicle according to an embodiment of the present disclosure (where a floor is illustrated)

In the present disclosure and the embodiments of the present disclosure, as shown in FIG. 12, a length direction of a chassis component is an X direction, and a width direction of the chassis component is a Y direction.

Figure 13:
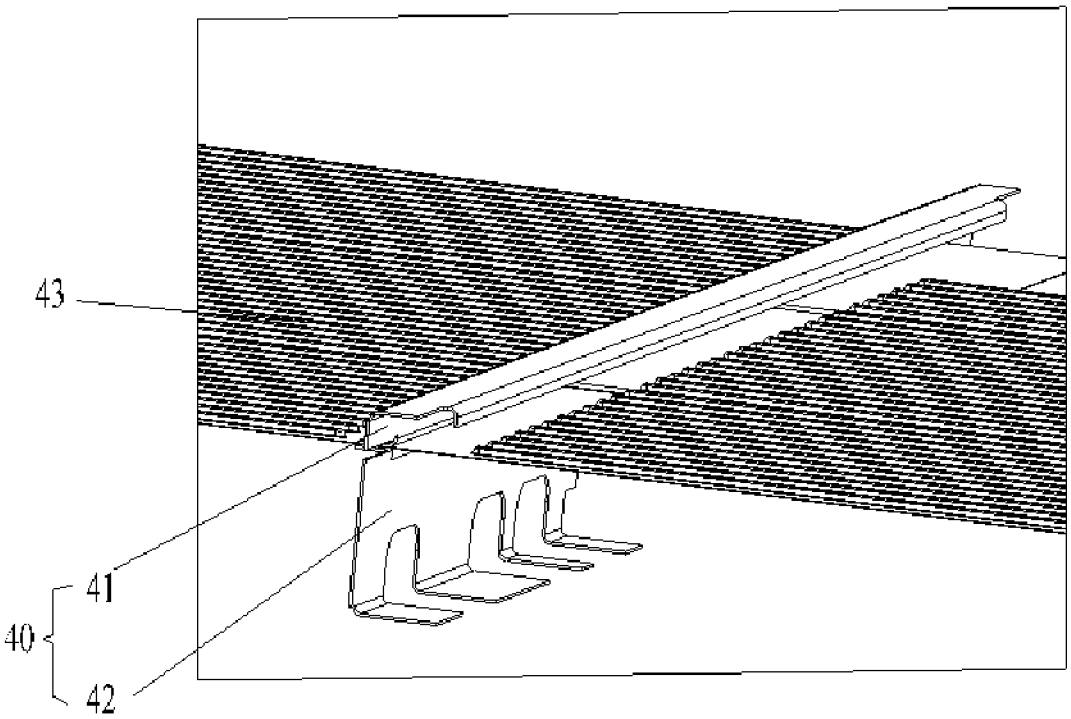
FIG. 13 illustrates a partial structural schematic diagram of the cooperation of a cross beam component and a floor of the chassis component in FIG. 12.

As shown in FIG. 12 and FIG. 13, an embodiment of the present disclosure provides a chassis component of a railway vehicle. The chassis component includes a lower boundary beam 20 and a cross beam component 40. There are two lower boundary beams 20, the two lower boundary beams 20 are provided at an interval. The cross beam component 40 is provided between the two lower boundary beams 20, there are a plurality of cross beam components 40, and the plurality of cross beam components 40 are provided at an interval along the length direction of the lower boundary beam 20, wherein at least one cross beam component 40 in the plurality of cross beam components 40 includes a first cross beam 41 and a second cross beam 42 provided below the first cross beam 41 in a height direction of the lower boundary beam 20, the first cross beam 41 and the second cross beam 42 form a mounting cavity, and a part of the floor 43 of the railway vehicle penetrates into the mounting cavity.

In an embodiment of the present disclosure, the cross beam component 40 includes a first cross beam 41 and a second cross beam 42, the first cross beam 41 and the second cross beam 42 are provided in sequence in the height direction of the lower boundary beam 20, so that the first cross beam 41 and the second cross beam 42 are both located in a space formed by the two lower boundary beams 20, and a mounting cavity is formed between the first cross beam 41 and the second cross beam 42. Thus, when the floor 43 is mounted in the mounting cavity of the cross beam component 40, the height of an upper surface of the floor 43 is lower than the height of an upper surface of the lower boundary beam 20. Compared with the related art in which the floor is directly paved above the cross beam, the embodiment enlarges the internal space of the vehicle when ensuring that the height of the chassis component is not increased. Further, at least a part of the floor 43 penetrates into the mounting cavity, and the floor 43 is sandwiched between the first cross beam 41 and the second cross beam 42, thereby improving the mounting strength of the floor 43.

Figure 14:
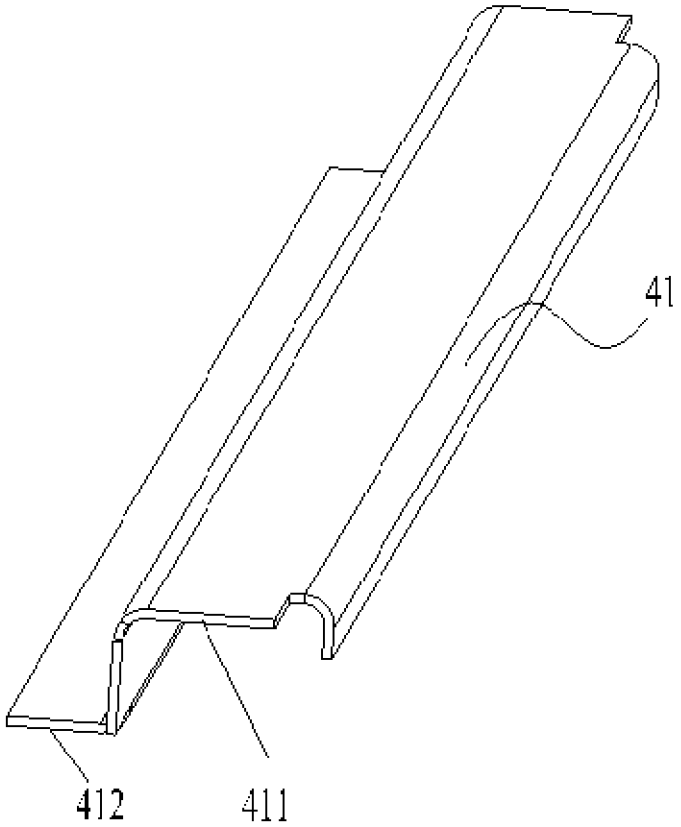
FIG. 14 illustrates a structural schematic diagram of a first cross beam of a cross beam component in FIG. 13.

As shown in FIG. 13 and FIG. 14, in an exemplary embodiment of the present disclosure, the first cross beam 41 includes a U-shaped beam 411 and a connecting beam 412 connected with the U-shaped beam 411, the connecting beam 412 is connected with the floor 43.

In an exemplary embodiment, the U-shaped beam 411 includes two opposite vertical segments and a horizontal segment connecting the two vertical segments, wherein one of the two vertical segments is connected with the connecting beam 412, and a height size of the vertical segment is greater than a height size of the other vertical segment in the two vertical segments.

By means of the arrangement, the strength of the U-shaped beam 411 is good, and the strength requirements for the chassis component of the railway vehicle are met. Further, the connecting beam 412 is of a flat plate structure, and the connecting beam 412 is in surface-to-surface contact with the floor 43, so that the connecting strength between the first cross beam 41 and the floor 43 is improved.

In an exemplary embodiment of the present disclosure, the U-shaped beam 411 and the connecting beam 412 are of an integrated forming structure.

The embodiment ensures the overall strength of the first cross beam 41, facilitates processing, and makes the integrity of the first cross beam 41 good.

Of course, in an alternative embodiment not illustrated in the present disclosure, the U-shaped beam 411 and the connecting beam 412 may be separately disposed, as long as the connecting strength between the U-shaped beam 411 and the connecting beam 412 can be ensured.

Figure 15:
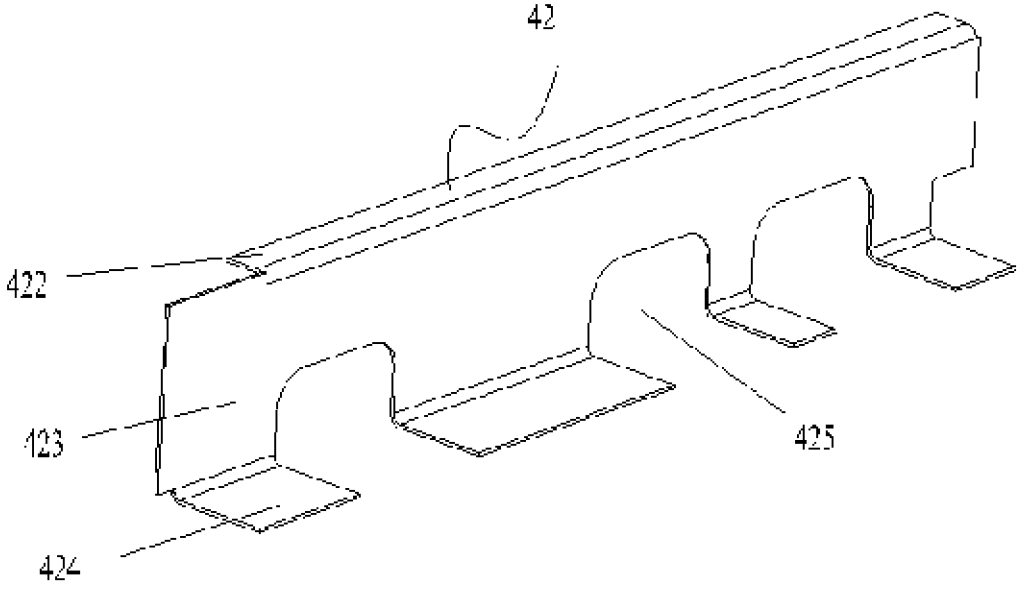
FIG. 15 illustrates a structural schematic diagram of a second cross beam of a cross beam component in FIG. 13.

As shown in FIG. 13 and FIG. 15, in an exemplary embodiment of the present disclosure, a cross section of the second cross beam 42 is Z-shaped in a width direction of the chassis component.

The embodiment makes the strength of the second cross beam 42 high. Compared with the related art in which the cross beam is usually C-shaped, the Z-shaped second cross beam 42 of the present embodiment can better meet the strength and rigidity requirements for the chassis component of the railway vehicle.

As shown in FIG. 15, in an exemplary embodiment of the present disclosure, the second cross beam 42 includes a first horizontal beam 422, a vertical beam 423 and a second horizontal beam 424 connected in sequence, the first horizontal beam 422 and the second horizontal beam 424 are located on two sides of the vertical beam 423 respectively, and the first horizontal beam 422 is connected with one side, away from the first cross beam 41, of the floor 43.

In the present embodiment, the first horizontal beam 422 and the second horizontal beam 424 are provided on two sides of the vertical beam 423, and a joint between the first horizontal beam 422 and the floor 43 is a surface-to-surface contact, so that the connecting strength between the first horizontal beam 422 and the floor 43 is better.

In an exemplary embodiment of the present disclosure, the first horizontal beam 422, the vertical beam 423 and the second horizontal beam 424 are of an integrated forming structure.

The embodiment ensures the overall strength of the first cross beam 41, facilitates processing, and makes the integrity of the first cross beam 41 good.

As shown in FIG. 15, in an exemplary embodiment of the present disclosure, the second cross beam 42 is provided with a wire passage groove 425, the wire passage groove 425 passing through the second horizontal beam 424 and extending to the vertical beam 423.

In the embodiment, a wire harness will pass through the lower part of the chassis component. Since the second cross beam 42 is located below the floor 43 and the wire passage groove 425 is provided on the second cross beam 42, the wire harness is convenient to penetrate out of the wire passage groove 425, which facilitates wiring of the railway vehicle and storage of the wire harness. Further, the wire harness is received in the wire passage groove 425, so that the wire harness is prevented from occupying a space below the chassis component and ensuring the compact structure and good integrity of the chassis component.

In an exemplary embodiment of the present disclosure, the floor 43 is welded to the first cross beam 41, and the floor 43 is welded to the second cross beam 42.

The embodiment ensures the connecting strength between the floor 43 and the cross beam component 40, the connecting beam 412 of the first cross beam 41 is in surface-to-surface contact with the floor 43, and the first horizontal beam 422 of the second cross beam 42 is also in surface-to-surface contact with the floor 43, thereby facilitating welding. Further, the floor 43 is sandwiched between the first cross beam 41 and the second cross beam 42, the second cross beam 42 supports the floor 43, and the floor 43 is firmly mounted.

In an exemplary embodiment of the present disclosure, the floor 43 is a corrugated plate. The strength of the corrugated plate is good, thereby ensuring the use strength of the floor 43.

As shown in FIG. 12, in an exemplary embodiment of the present disclosure, two opposite ends of the first cross beam 41 correspond to the two lower boundary beams 20 respectively along the width direction of the chassis component, and a distance between the two ends of the first cross beam 41 is smaller than or equal to a distance between the two lower boundary beams 20.

In an exemplary embodiment, two opposite ends of the first cross beam 41 are abutted against the two lower boundary beams 20 respectively. The embodiment ensures the overall width of the chassis component, and the first cross beam 41 abuts against the two lower boundary beams 20. Not only the second cross beam 42 supports the first cross beam 41, but also the lower boundary beam 20 connected with the first cross beam 41 may also support the first cross beam 41, so that the connecting strength between the first cross beam 41 and the lower boundary beam 20 is further ensured, and the structure and apparatus provided at the upper part of the chassis component may be effectively supported.

In an exemplary embodiment, an upper surface of the first cross beam 41 is flush with an upper surface of the lower boundary beam 20.

The embodiment facilitates mounting of the device at the upper part of the chassis component, the flatness is better, and the device is steadily mounted. Further, the arrangement forms a planar grid structure by the upper surface of the first cross beam 41 and the upper surface of the lower boundary beam 20, the supporting strength is good, and the requirements for the strength and rigidity of the chassis component are met.

Figure 16:
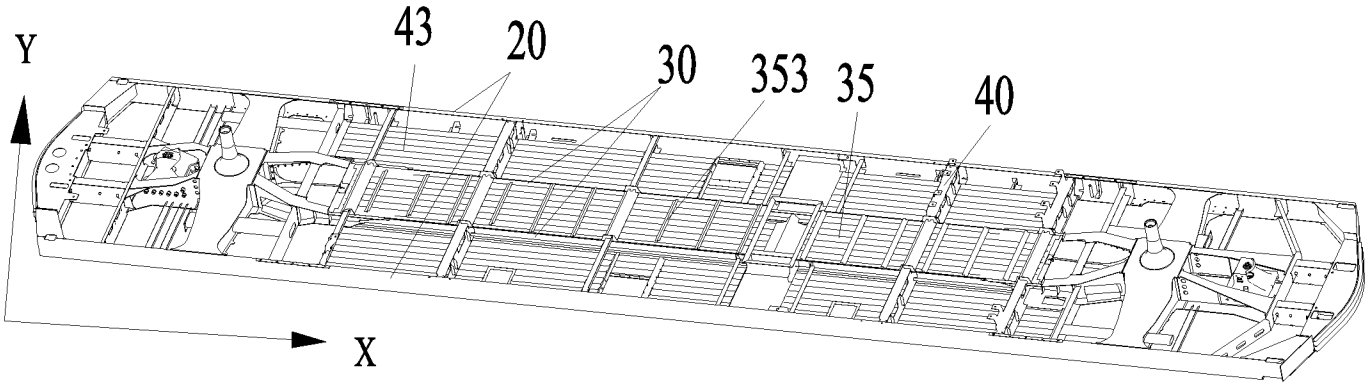
FIG. 16 illustrates a third structural schematic diagram of a chassis component of a railway vehicle according to an embodiment of the present disclosure (where a floor is illustrated)

In the present disclosure and the embodiments of the present disclosure, as shown in FIG. 16, a length direction of a chassis component is an X direction, and a width direction of the chassis component is a Y direction.

Figure 19:
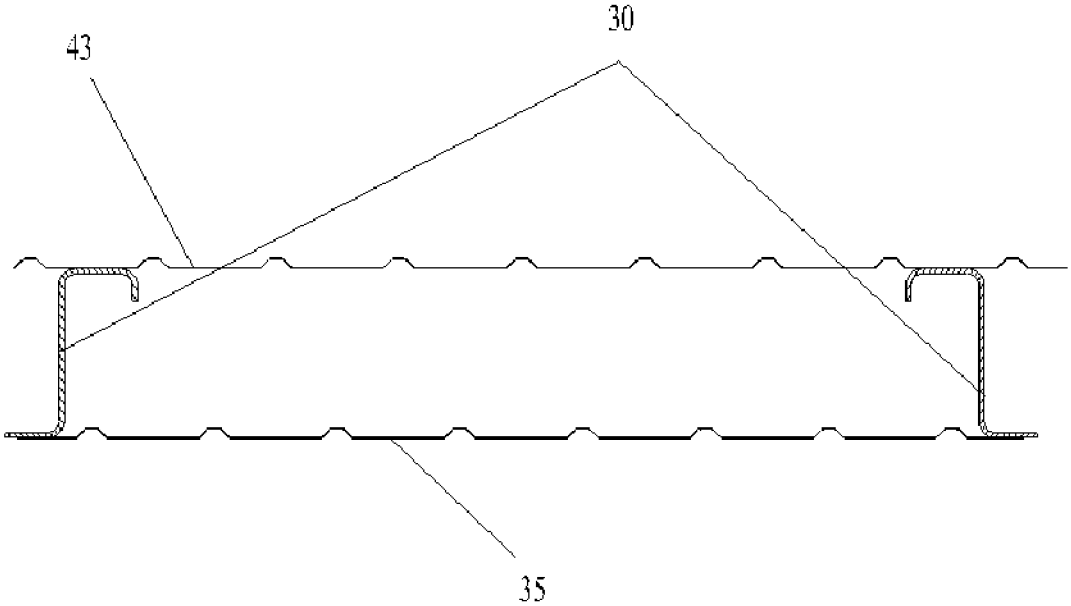
FIG. 19 illustrates an M-M direction sectional view in FIG. 17.

As shown in FIG. 16 and FIG. 19, an embodiment of the present disclosure provides a chassis component of a railway vehicle. The chassis component of the present embodiment includes two lower boundary beams 20 and a middle beam 30. The two lower boundary beams 20 are provided at an interval, the middle beam 30 is provided between the two lower boundary beams 20, the middle beam 30 extends along the length direction of the lower boundary beam 20, and the cross section of the middle beam 30 is Z-shaped in the width direction of the railway vehicle.

In the present embodiment, since the cross section of the middle beam 30 is Z-shaped, the structural strength of the middle beam 30 is better. Also since the length extending directions of the middle beam 30 and the lower boundary beam 20 are the same, the middle beam 30 and the lower boundary beam 20 may be supporting beams in the length direction of the chassis component at the same time. Therefore, the embodiment ensures the strength requirements for the middle beam 30, and improves the overall strength and rigidity of the chassis component. Compared with the middle beam having a C-shaped cross section in the related art, the middle beam 30 in the embodiment of the present disclosure is higher in strength and better in supporting effect.

Figure 20:
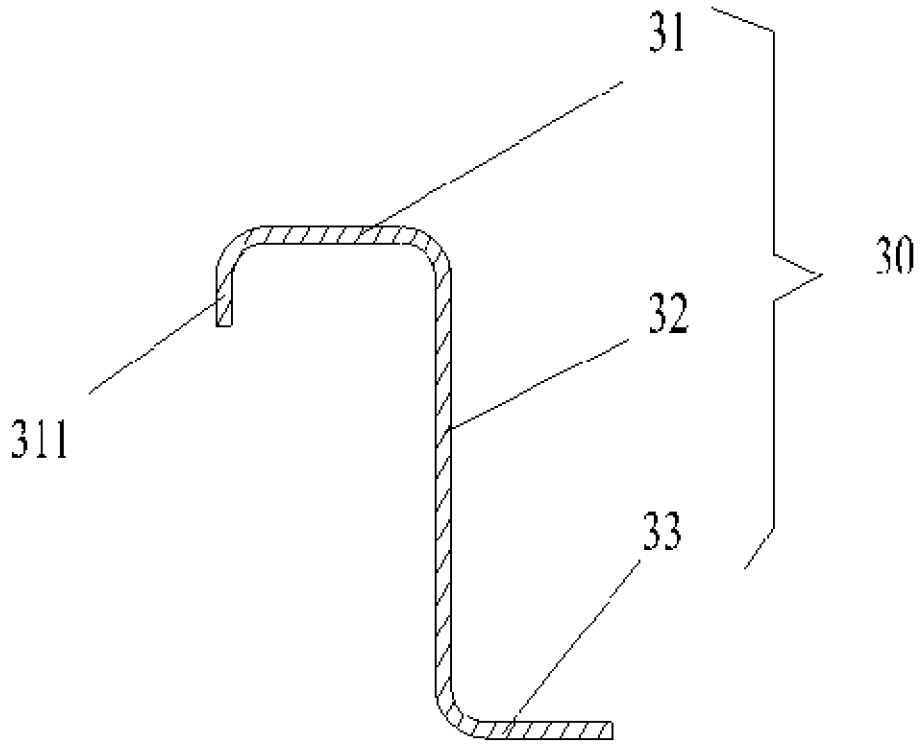
FIG. 20 illustrates an enlarged view of a middle beam in FIG. 19.

As shown in FIG. 20, in an exemplary embodiment of the present disclosure, the middle beam 30 includes a first horizontal segment 31, a vertical segment 32 and a second horizontal segment 33 connected in sequence, the first horizontal segment 31 and the second horizontal segment 33 are provided on two opposite sides of the vertical segment 32 respectively.

Specifically, the first horizontal segment 31 and the second horizontal segment 33 in the present embodiment are provided on two opposite sides of the vertical segment 32 respectively, the bearing force is transferred to other parts by the vertical segment and the second horizontal segment, the bearing pressure of the middle beam 30 can be effectively scattered, and the structural strength of the middle beam 30 is improved.

Further, in an exemplary embodiment of the present disclosure, the chassis component includes two opposite middle beams 30, and the first horizontal segments 31 of the two middle beams 30 are close to each other in the width direction of the chassis component, so that when the chassis component bears the pressure, the two middle beams 30 can share the pressure from the upper part of the chassis component, and the strength and rigidity requirements for the chassis component are met.

In an exemplary embodiment of the present disclosure, one end, away from the vertical segment 32, of the first horizontal segment 31 is provided with a bending portion 311. The arrangement of the bending portion 311 further improves the structural strength of the middle beam 30.

In an exemplary embodiment, as shown in FIG. 19 and FIG. 20, the bending portion 311 bends toward one side where the second horizontal segment 33 is located. By providing the bending portion 311, a tail end of the first horizontal segment 31 extends downward, thereby avoiding the problem that an installer is easily scratched during the assembly process due to the sharp tail end of the first horizontal segment 31.

In an exemplary embodiment, the first horizontal segment 31, the vertical segment 32 and the second horizontal segment 33 are of an integrated forming structure. The embodiment improves the overall structure strength of the middle beam 30, and meets the strength and rigidity requirements for the chassis component. The middle beam 30 is good in integrity, facilitates processing, and simplifies the assembly process.

Figure 17:
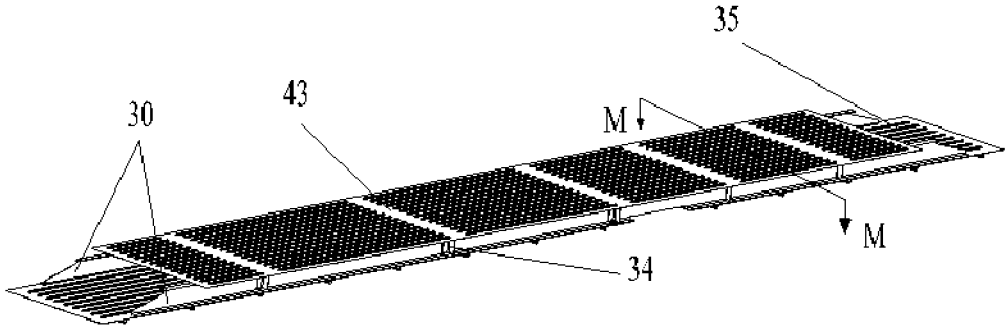
FIG. 17 illustrates a structural schematic diagram of the cooperation of a middle beam and a cover plate of the chassis component and a floor of a railway vehicle in FIG. 16.

As shown in FIG. 16 and FIG. 17, in an embodiment of the present disclosure, the railway vehicle further includes a floor 43, the floor 43 covers the middle beam 30, and the floor 43 is connected with each lower boundary beam 20; and the chassis component further includes a cover plate 35, the cover plate 35 is connected with the middle beam 30, the middle beam 30 is located between the floor 43 and the cover plate 35, and the floor 43, the cover plate 35 and the middle beam 30 jointly enclose a main air duct of the railway vehicle.

Specifically, the chassis component shown in FIG. 16 is a structural schematic diagram viewed up from the bottom of the railway vehicle. The middle beam 30 in the present embodiment is provided between the two lower boundary beams 20, the floor 43 is provided above two middle beams 30, and two ends of the floor 43 are connected with each lower boundary beam 20 along the width direction of the chassis component, so that the middle beams 30 and the two lower boundary beams 20 support the floor 43 simultaneously, thereby ensuring the connecting strength of the floor 43.

In an exemplary embodiment, as shown in FIG. 19, a cover plate 35 is provided at the lower parts of the two middle beams 30, and the cover plate 35 is used for covering spacing between the two middle beams 30, so that the cover plate 35, the floor 43 and the middle beams 30 jointly enclose a main air duct located on the chassis component.

By means of the arrangement, the main air duct on the chassis component facilitates circulation of air, the main air duct and the lower boundary beam 20 jointly share pressure above the chassis component, and the floor 43 of the main air duct and the cover plate 35 are of a flat plate structure, thereby increasing the bearing area, effectively scattering the pressure, and improving the bearing capacity of the chassis component.

In an exemplary embodiment of the present disclosure, the floor 43 is a corrugated plate, and the cover plate 35 is a corrugated plate.

In an exemplary embodiment of the present disclosure, the extending direction of ripples of the floor 43 and the cover plate 35 is consistent with the length extending direction of the lower boundary beam 20. Since the length of the railway vehicle is much greater than the width of the railway vehicle, the strength requirements for the railway vehicle in the length direction are higher. Therefore, the arrangement of the corrugated plate ensures the strength of the floor 43 and the cover plate 35, so that the main air duct and the lower boundary beam 20 have the supporting function together in the length direction of the railway vehicle, thus improving the strength of the chassis component.

In an exemplary embodiment of the present disclosure, the floor 43 is welded to the middle beam 30, and the cover plate 35 is also welded to the middle beam 30. Moreover, spot welding sealants are provided at a joint between the middle beam 30 and the floor 43 and a joint between the middle beam 30 and the cover plate 35, and are used for sealing gaps in the joints, thus improving the connecting strength between the middle beam 30 and the floor 43 as well as the cover plate 35.

Figure 18:
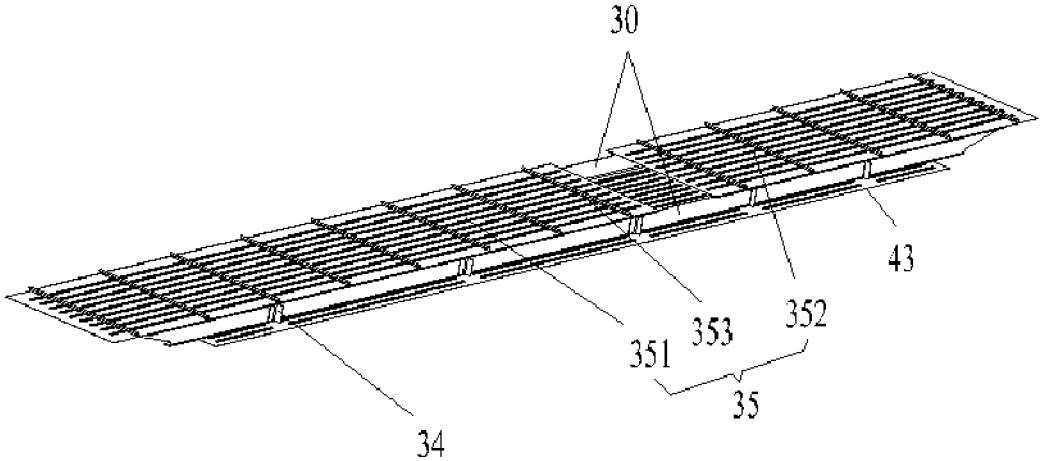
FIG. 18 illustrates a structural schematic diagram of FIG. 17 in another direction.

As shown in FIG. 18, in an exemplary embodiment of the present disclosure, the cover plate 35 includes a first cover plate 351 and a second cover plate 352 spaced from the first cover plate 351, spacing between the first cover plate 351 and the second cover plate 352 forming an air inlet communicated with the main air duct.

Specifically, the first cover plate 351 and the second cover plate 352 are provided at an interval in the length direction of the lower boundary beam 20, so as to form an air inlet communicated with the main air duct. The embodiment ensures an air source of the main air duct on the chassis component. Further, the floor 43 is provided with a plurality of air outlets. Air entering the main air duct from the air inlet may enter into the railway vehicle from the air outlets, thereby ensuring the circulation of air inside the railway vehicle, and improving the user experience.

As shown in FIG. 18, in an exemplary embodiment of the present disclosure, the chassis component further includes a plurality of reinforcing ribs 353, the plurality of reinforcing ribs 353 are provided on the cover plate 35 at an interval.

In an exemplary embodiment, the reinforcing ribs 353 are provided on the cover plate 35 at an interval along the length direction of the lower boundary beam 20. The reinforcing ribs 353 effectively improve the strength of the cover plate 35 in the width direction, and the reinforcing ribs 353 are matched with longitudinal ripples of the corrugated plate, so that the strength and rigidity of the cover plate 35 meet the requirements for the chassis component.

In an exemplary embodiment, the reinforcing ribs 353 are provided on the cover plate 35 in a welding manner.

As shown in FIG. 16, in an exemplary embodiment of the present disclosure, the chassis component further includes a plurality of cross beam components 40 provided between the two lower boundary beams 20, the plurality of cross beam components 40 are provided at an interval along the length direction of the lower boundary beam 20, and there is an included angle between the middle beam 30 and each cross beam component 40.

In an exemplary embodiment, each cross beam component 40 is vertical to the middle beam 30, and each cross beam component 40 is also vertical to the two lower boundary beams 20. The embodiment makes the chassis component form a structure similar to a grid, thus improving the strength and rigidity of the chassis component, and ensuring the mounting and normal operation of the device on the chassis component.

As shown in FIG. 17 and FIG. 18, in an exemplary embodiment of the present disclosure, the middle beam 30 is provided with a plurality of reinforcing members 34, and the plurality of reinforcing members 34 are in one-to-one correspondence with the plurality of cross beam components 40.

The embodiment ensures the connecting strength between the middle beam 30 and the each cross beam component 40, thus ensuring the strength and rigidity of the chassis component.

In an exemplary embodiment, the reinforcing member 34 includes a first reinforcing structure 341 and a second reinforcing structure 342, the first reinforcing structure 341 and the second reinforcing structure 342 form an included angle, and the first reinforcing structure 341 is provided on the vertical segment 32 of the middle beam 30.

Figure 21:
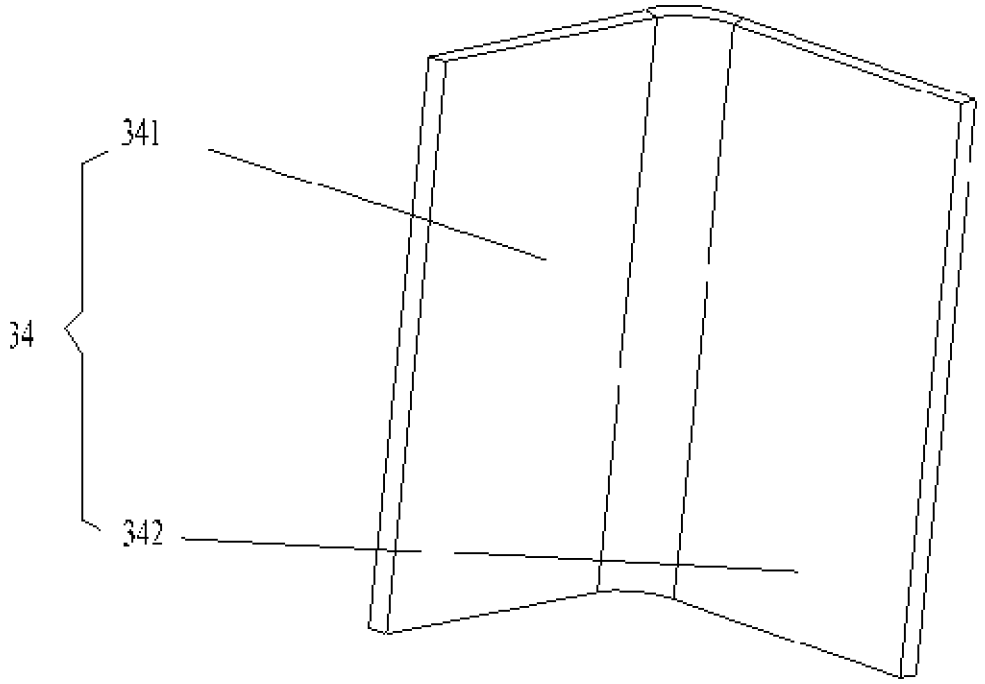
FIG. 21 illustrates a structural schematic diagram of a reinforcing member in FIG. 17.

In an exemplary embodiment of the present disclosure, as shown in FIG. 21, the reinforcing member 34 is L-shaped angle iron, the L-shaped angle iron includes a first reinforcing segment and a second reinforcing segment vertically connected with the first reinforcing segment, wherein the first reinforcing segment forms the first reinforcing structure 341, and the second reinforcing segment forms the second reinforcing structure 342. The first reinforcing segment of the L-shaped angle iron is welded to the vertical segment 32 of the middle beam 30, and the second reinforcing segment of the L-shaped angle iron is welded to the cross beam component 40, so that the middle beam 30 and the cross beam component 40 are connected together, and the connecting strength between the middle beam 30 and the cross beam component 40 is good.

Most of the main air ducts of the traditional railway vehicle are mounted on a roof. In some embodiments of the present disclosure, the main air duct of the railway vehicle is arranged on the chassis component, more under-vehicle devices need to be hung at the lower part of the chassis component of the railway vehicle, and there is no extra space. Therefore, on the premise of ensuring the sufficient strength of the chassis component, the main air duct is formed by using the middle beam 30, the floor 43 and the cover plate 35 of the chassis component, so that the problem of provision of the main air duct is solved.

In an exemplary embodiment, firstly, a main air duct is formed by using the middle beam 30, the floor 43 and the cover plate 35 of the chassis component in a spot welding manner; and then, the cross section of the middle beam 30 of the chassis component is Z-shaped, and the front and rear ends of the middle beam 30 are in inserted connection with an in-sleeper longitudinal beam, so that the chassis component forms a whole, thereby improving the strength of the chassis component.

The middle beam 30 in an exemplary embodiment of the present disclosure is provided in a middle of the chassis component, and jointly achieves a longitudinal supporting function with the lower boundary beam 20. The cross section of the middle beam 30 is Z-shaped, the bearing capacity is high, and the front and rear ends of the middle beam 30 are connected with an in-sleeper longitudinal beam of an end chassis, so that the chassis component forms an integrated structure, and the floor 43 and the cover plate 35 are welded to two middle beams 30 to form a hollow cavity. The floor 43 is provided with an air outlet, an air inlet is formed between the first cover plate 351 and the second cover plate 352, and the air inlet and the air outlet are both communicated with the main air duct, so that the circulation of air inside the railway vehicle is ensured, and the user experience is improved.

Figure 22:
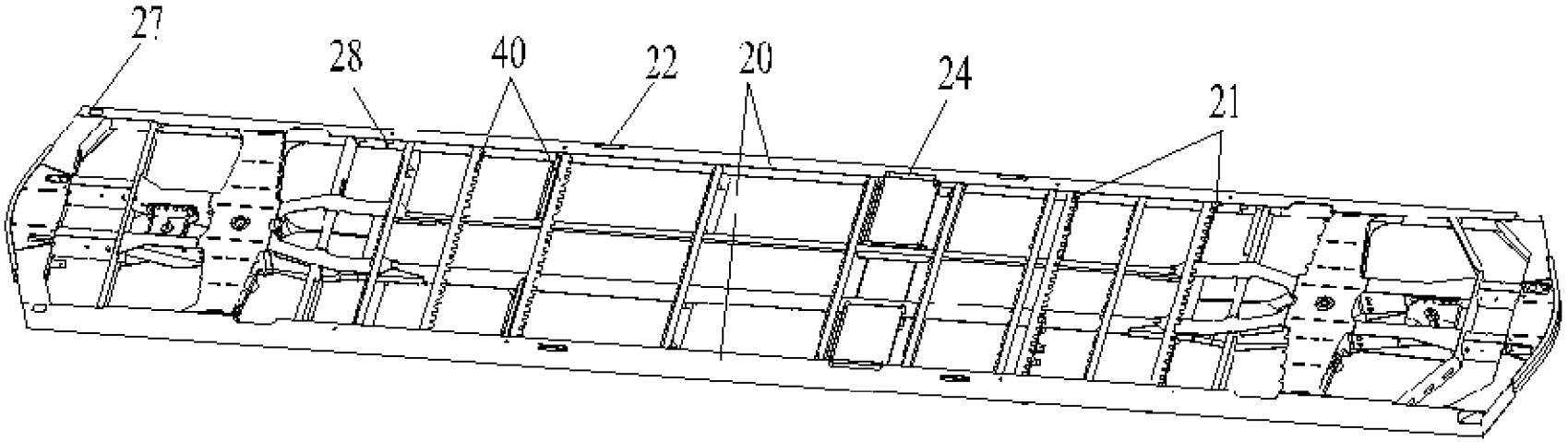
FIG. 22 illustrates a fourth structural schematic diagram of a chassis component of a railway vehicle according to an embodiment of the present disclosure.
Figure 23:
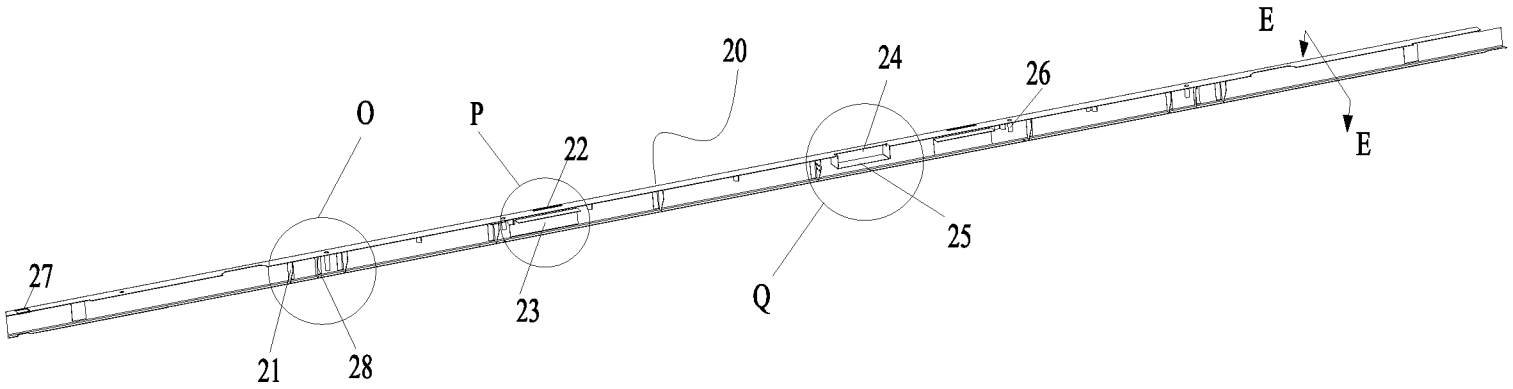
FIG. 23 illustrates a structural schematic diagram of a lower boundary beam of the chassis component in FIG. 22.
Figure 25:
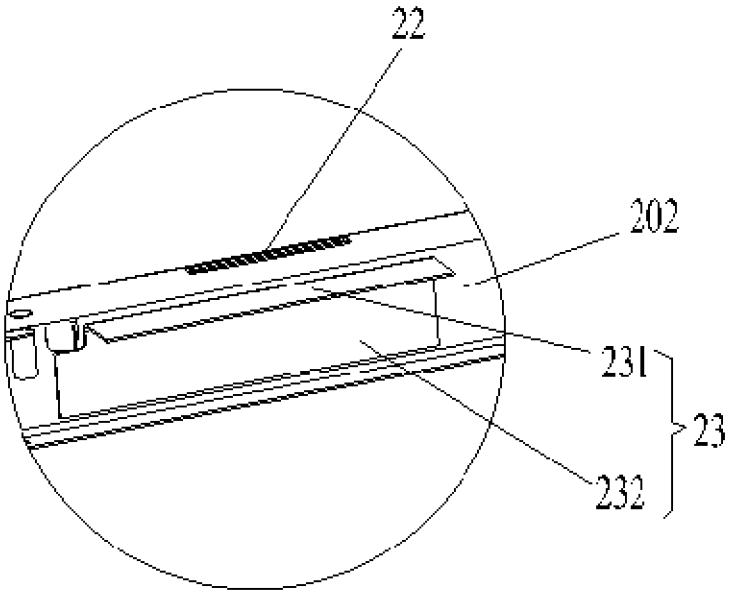
FIG. 25 illustrates a partial enlarged schematic diagram of a part P of the lower boundary beam in FIG. 23.

As shown in FIG. 22, FIG. 23 and FIG. 25, an embodiment of the present disclosure provides a chassis component of a railway vehicle. The chassis component of the present embodiment includes two lower boundary beams 20 and a pipe passage structure 22. The two lower boundary beams 20 are provided at an interval. One side, facing a vehicle body of the railway vehicle, of at least one lower boundary beam 20 is provided with the pipe passage structure 22, wherein the pipe passage structure is a pipe passage channel provided on the lower boundary beam 20.

In the embodiment, since the pipe passage structure 22 is provided on the lower boundary beam 20, a pipeline passing from the upside of the railway vehicle to the downside or a pipeline passing from the downside of the railway vehicle to the upside may penetrate out of the pipe passage structure 22, so as to achieve the penetration of a pipeline on the chassis component of the railway vehicle, thus avoiding additional arrangement of the structure for pipeline penetration on the chassis component, saving space on the chassis component, and making the structure of the entire chassis component compact. Therefore, the embodiment effectively utilizes the effective space of the chassis component, facilitates penetration of a pipeline on the chassis component, and simplifies the overall structure of the chassis component.

In an exemplary embodiment, the pipe passage structure 22 is particularly applied to penetration of an air conditioning pipeline, and the pipe passage channel in the present application is a hole for a pipe to pass through or a groove for a pipe to pass through provided on the lower boundary beam 20. Of course, in an alternative embodiment not illustrated in the present disclosure, the pipe passage structure 22 may also be applied to penetration of other pipelines or lines.

As shown in FIG. 23 and FIG. 25, in an exemplary embodiment of the present disclosure, the chassis component further includes a first reinforcing member 23, the first reinforcing member 23 is located on one side, away from the vehicle body, of the pipe passage structure 22, and the first reinforcing member 23 is connected with a part of the lower boundary beam 20.

In an exemplary embodiment, the first reinforcing member 23 is provided below the pipe passage structure 22, so as to reinforce the periphery of the pipe passage structure 22. The embodiment ensures the surrounding structure strength of the pipe passage structure 22, thus ensuring the structural strength of the lower boundary beam 20. Therefore, the lower boundary beam 20 not only facilitates penetration of the pipeline on the chassis component, but also ensures the own strength of the lower boundary beam 20.

Figure 27:
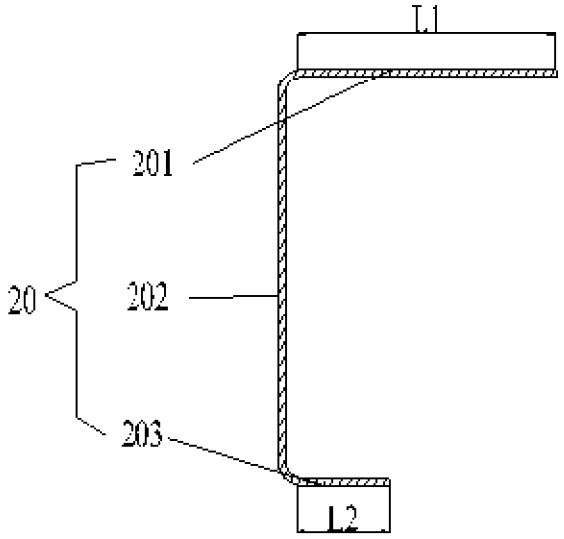
FIG. 27 illustrates an E-E sectional view of the lower boundary beam in FIG. 23.

As shown in FIG. 27, in an exemplary embodiment of the present disclosure, the lower boundary beam 20 includes a first flat plate 201, a vertical plate 202 and a second flat plate 203. The first flat plate 201 is spaced from the second flat plate 203, and the vertical plate 202 is used for connecting the first flat plate 201 and the second flat plate 203.

In an exemplary embodiment of the present disclosure, the cross section of the lower boundary beam 20 is U-shaped along the length direction of the lower boundary beam 20. The structure makes the strength of the lower boundary beam 20 higher, improves the bearing capacity of the lower boundary beam 20, and meets the strength requirements of the railway vehicle for the lower boundary beam 20. Moreover, the weight of the structure is light, the weight of the entire chassis component is reduced, and the light weight of the chassis component is realized.

In an exemplary embodiment, the pipe passage structure 22 is provided on the first flat plate 201, which facilitates penetration of a pipeline on the chassis component.

In an exemplary embodiment as shown in FIG. 25, the first reinforcing member 23 is fixedly connected with the vertical plate 202.

The first reinforcing member 23 is welded to the vertical plate 202, thereby improving the structural strength of the lower boundary beam 20 in the height direction.

As shown in FIG. 25, in an exemplary embodiment of the present disclosure, the first reinforcing member 23 includes a first reinforcing plate 231 and a second reinforcing plate 232 connected with the first reinforcing plate 231, wherein an included angle is provided between the first reinforcing plate 231 and the second reinforcing plate 232, and the first reinforcing plate 231 is fixedly connected with the vertical plate 202.

In an exemplary embodiment, the first reinforcing plate 231 is vertical to the second reinforcing plate 232, the first reinforcing plate 231 is welded to the vertical plate 202, the second reinforcing plate 232 is parallel to the first flat plate 201, and spacing is provided between the second reinforcing plate 232 and the first flat plate 201. By means of the arrangement, when the pipeline on the chassis component passes through the pipe passage structure 22, the second reinforcing plate 232 may support the pipeline, which facilitates penetration of the pipeline on the chassis component. The second reinforcing plate 232 may also restrain the pipeline, so that the pipeline is arranged according to a predetermined path.

As shown in FIG. 27, in an exemplary embodiment of the present disclosure, a width size L1 of the first flat plate 201 is greater than a width size L2 of the second flat plate 203.

The pipe passage structure 22 in the embodiment is provided on the first flat plate 201, the width size L1 of the first flat plate 201 is greater than the width size L2 of the second flat plate 203, and a provision space is reserved for the pipe passage structure 22. Moreover, the strength of the first flat plate 201 after the pipe passage structure 22 is provided is ensured, thus ensuring the structural strength of the lower boundary beam 20.

Figure 24:
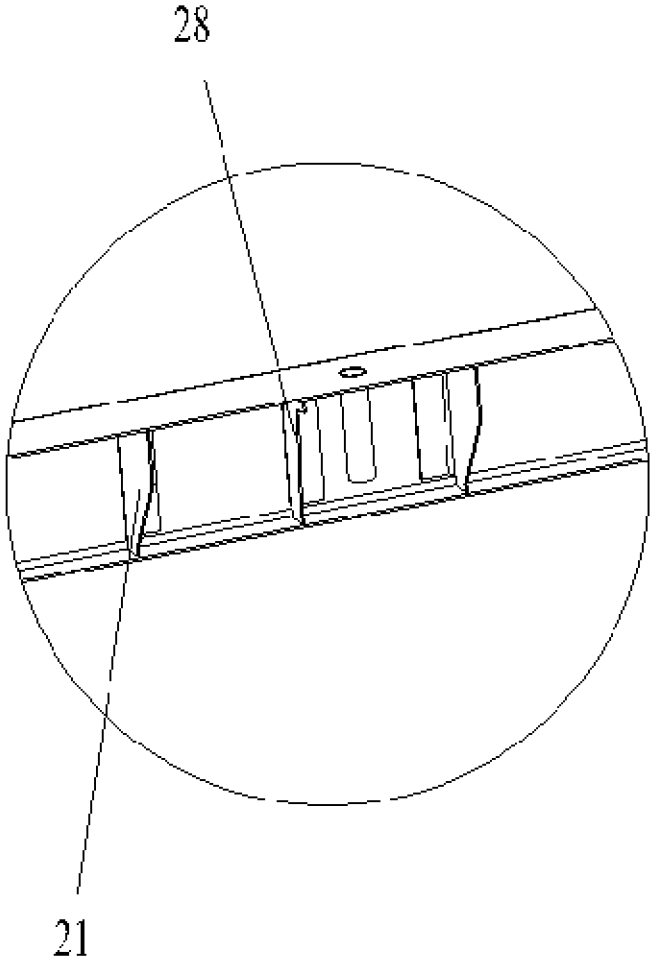
FIG. 24 illustrates a partial enlarged schematic diagram of a part 0 of the lower boundary beam in FIG. 23.

As shown in FIG. 22 to FIG. 24, in an exemplary embodiment of the present disclosure, at least one lower boundary beam 20 is further provided with a plurality of second reinforcing members 28, the plurality of second reinforcing members 28 are provided at an interval in the length direction of the lower boundary beam 20.

In the embodiment, the plurality of second reinforcing members 28 are provided at an interval in the length direction of the lower boundary beam 20, so as to reinforce the lower boundary beam 20, thereby ensuring the structural strength of the lower boundary beam 20.

Figure 26:
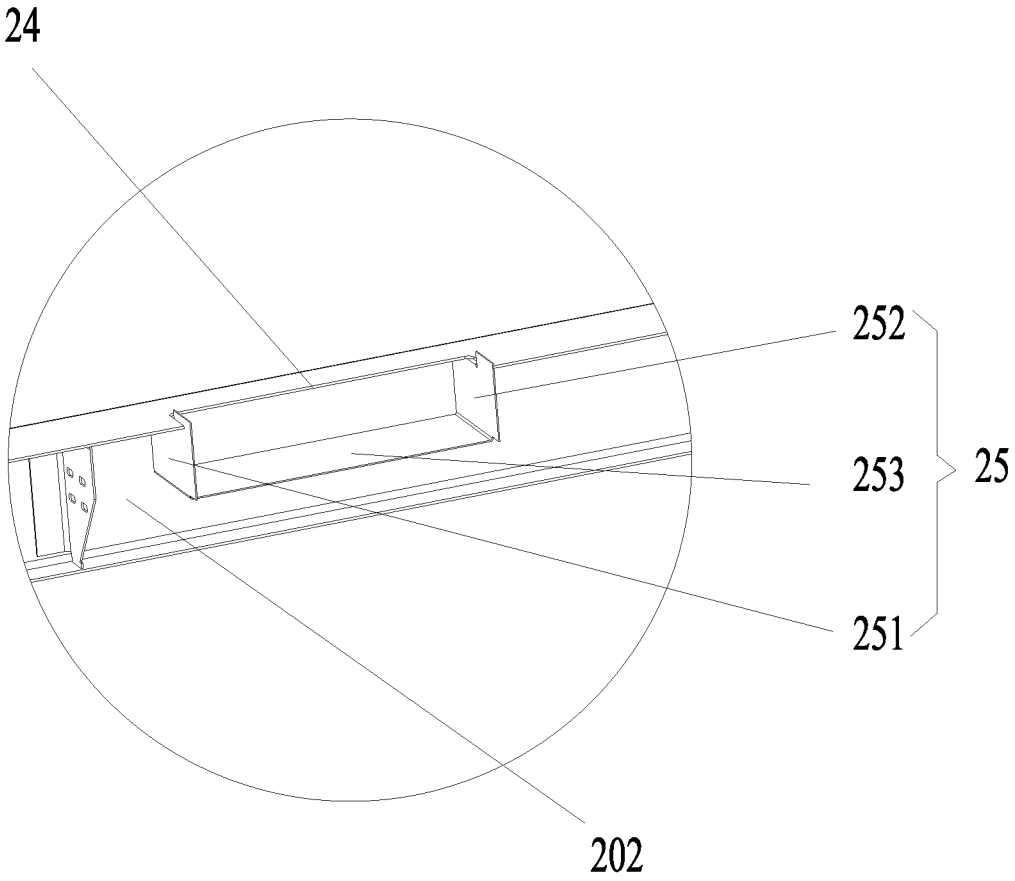
FIG. 26 illustrates a partial enlarged schematic diagram of a part Q of the lower boundary beam in FIG. 23.

As shown in FIG. 23 and FIG. 26, in an exemplary embodiment of the present disclosure, the chassis component further includes a main air duct and a branch air duct communicated with the main air duct, and the lower boundary beam 20 is provided with a ventilation opening 24 communicated with the branch air duct.

In an exemplary embodiment, the chassis component includes a middle beam provided between two lower boundary beams 20, a cover plate is provided on the two middle beams, and the cover plate, the two middle beams and the floor provided on the chassis component form a main air duct. The main air duct in the present embodiment is provided along the length direction of the lower boundary beam 20, the branch air duct is vertical to the main air duct, and the lower boundary beam 20 is provided with a ventilation opening 24 communicated with the branch air duct.

The arrangement of the ventilation opening 24 ensures an air source of the main air duct and the branch air duct on the chassis component. Air entering the branch air duct from the ventilation opening 24 may circulate in the main air duct and the branch air duct, thereby ensuring the circulation of air inside the railway vehicle, and improving the user experience.

In an exemplary embodiment of the present disclosure, the chassis component further includes a ventilation pipeline, an inner wall surface of the ventilation pipeline encloses a branch air duct, a supporting seat 25 is provided at a position, corresponding to the ventilation opening 24, on the lower boundary beam 20, and the ventilation pipeline is connected with the supporting seat 25.

The branch air duct in the embodiment is formed from the ventilation pipeline on the chassis component, and two ends of the ventilation pipeline are provided on the supporting seat 25, so that the branch air duct is communicated with the ventilation opening 24, thus ensuring the circulation of air inside the branch air duct.

As shown in FIG. 26, in an exemplary embodiment of the present disclosure, the supporting seat 25 includes a first edge plate 251, a second edge plate 252 and a third edge plate 253. The first edge plate 251 is connected with the vertical plate 202; the second edge plate 252 and the first edge plate 251 are provided at an interval; and the third edge plate 253 is used for connecting the first edge plate 251 and the second edge plate 252, and a ventilation pipeline is provided on the third edge plate 253.

In an exemplary embodiment, the first edge plate 251, the second edge plate 252 and the third edge plate 253 are all welded to the vertical plate 202, so that the connecting strength between the supporting seat 25 and the lower boundary beam 20 is ensured, and the structural strength of the lower boundary beam 20 is improved.

In an exemplary embodiment, the first edge plate 251, the second edge plate 252 and the third edge plate 253 are connected to form the supporting seat 25, thereby ensuring the supporting stability of the ventilation pipeline.

In an exemplary embodiment, the third edge plate 253 is parallel to the first flat plate 201. The embodiment ensures the steady mounting of the ventilation pipeline on the supporting seat.

In an exemplary embodiment, the cross section of the supporting seat 25 is U-shaped along the width direction of the chassis component.

As shown in FIG. 22 and FIG. 23, in an exemplary embodiment of the present disclosure, the chassis component further includes a plurality of cross beam components 40 provided between the two lower boundary beams 20, the plurality of cross beam components 40 are provided at an interval along a length direction of the lower boundary beam 20, at least one of the lower boundary beams 20 is provided with a connecting seat 21, and at least one end of the cross beam component 40 is connected with the lower boundary beam 20 through the connecting seat 21.

In an exemplary embodiment, the connecting seat 21 is in surface-to-surface contact with the cross beam component 40, and the connecting seat 21 is in surface-to-surface contact with the lower boundary beam 20. Thus, a connecting relationship between the cross beam component 40 and the lower boundary beam 20 is converted into connection between the cross beam component 40 and the connecting seat 21 and connection between the connecting seat 21 and the lower boundary beam 20, and a line-to-surface contact between the cross beam component 40 and the lower boundary beam 20 in the related art is converted into a surface-to-surface contact through the connecting seat 21, thereby improving the connecting strength between the cross beam component 40 and the lower boundary beam 20, and ensuring the strength and rigidity requirements for the chassis component. Further, compared with a line-to-surface contact achieved by welding or clamping between the cross beam component 40 and the lower boundary beam 20 in the related art, the surface-to-surface contact in some embodiments more facilitates connection, facilitates assembly of the chassis component by an operator, and improves the assembly efficiency.

Figure 28:
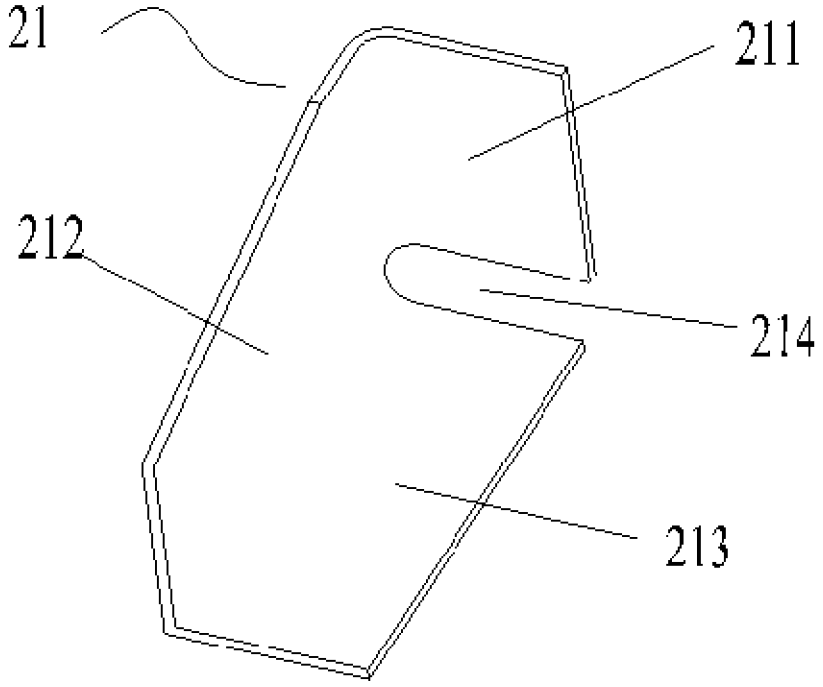
FIG. 28 illustrates a structural schematic diagram of a connecting seat in FIG. 23.

As shown in FIG. 24 and FIG. 28, in an exemplary embodiment of the present disclosure, the connecting seat 21 includes a first connecting plate 211, a second connecting plate 212 and a third connecting plate 213. The first connecting plate 211 is connected with the vertical plate 202; the second connecting plate 212 forms an included angle with the first connecting plate 211, and the second connecting plate 212 is connected with the cross beam component 40; and the third connecting plate 213 forms an included angle with the first connecting plate 211 and the second connecting plate 212 respectively, the third connecting plate 213 is connected with the first flat plate 201 or the second flat plate 203.

In an exemplary embodiment, the connecting seat 21 is composed of three connecting plates, any two connecting plates are vertically connected, the connection between the cross beam component 40 and the lower boundary beam 20 is converted into the connection between the cross beam component 40 and the connecting seat 21 and the connection between the connecting seat 21 and the lower boundary beam 20 by providing the connecting seat 21. Thus, a line connection or a point connection between the cross beam component 40 and the lower boundary beam 20 in the related art is converted into a surface connection between the cross beam component 40 and the connecting seat 21 and a surface connection between the connecting seat 21 and the lower boundary beam 20. Therefore, the arrangement improves the connecting strength of the cross beam component 40 connected to the lower boundary beam 20, and ensures the rigidity requirements for the chassis component of the railway vehicle.

In an exemplary embodiment, as shown in FIG. 24, the connecting seat 21 and the second reinforcing member 28 are cooperatively provided on the lower boundary beam 20 to form a reinforcing concentration area, so that when the chassis component or the entire railway vehicle is hoisted, it can be hoisted in the reinforcing concentration area. Since the strength of the reinforcing concentration area is high, it is not prone to deformation during the hoisting process, thereby ensuring the good integrity of the entire chassis component.

As shown in FIG. 23, in an exemplary embodiment of the present disclosure, the lower boundary beam 20 is further provided with a drain hole 26.

The provision of the drain hole 26 facilitates the drainage of water gathered on the chassis component, thereby avoiding corrosion of the chassis component caused by the gathered water.

In an exemplary embodiment, the lower boundary beam 20 is further provided with a wire passage through hole, which facilitates the penetration of a wire harness on the chassis component.

From the above description, it can be seen that some embodiments of the present disclosure achieves the following technical effects: a plurality of vertical plates are provided on the outer wall surface of the center pin to form the mounting frame, so that the connecting area between the center pin and the web structure is increased, thus improving the connecting strength between the center pin and the web structure. Compared with the screw-based threaded connection between the center pin disposed on the bogie and the sleeper beam in the related art, in some embodiments of the present disclosure, the mounting frame is additionally provided to connect the center pin and the web structure of the sleeper beam, the plurality of vertical plates are used to increase the connecting strength between the mounting frame and the center pin, and then the mounting frame provided with the center pin is connected to the web structure, so that the connecting strength between the center pin and the web structure is improved, thus improving the overall strength of the sleeper beam.

The above is only the preferred embodiments of the present disclosure, not intended to limit the present disclosure. As will occur to those skilled in the art, the present disclosure is susceptible to various modifications and changes. Any modifications, equivalent replacements, improvements and the like made within the spirit and principle of the present disclosure shall fall within the scope of protection of the present disclosure.

What is claimed is:

1. A chassis component of a railway vehicle, comprising two lower boundary beams provided at an interval and a sleeper beam provided between the two lower boundary beams, the sleeper beam comprising:

a web structure;

a center pin, connected with a bogie of a railway vehicle; and a mounting frame, connected with the web structure, the center pin being provided on the mounting frame, the mounting frame comprising a plurality of vertical plates, and the plurality of vertical plates being provided at an interval along an outer wall surface of the center pin, the plurality of vertical plates is provided on the outer wall surface of the center pin in an X shape, each of the plurality of vertical plates being welded to the outer wall surface of the center pin.

2. The chassis component as claimed in claim 1, wherein the sleeper beam comprises two web structures, the mounting frame being located between the two web structures.

3. The chassis component as claimed in claim 2, wherein the sleeper beam further comprises a plurality of rib plates, each of the two web structures comprises two webs provided at an interval, the plurality of rib plates is provided between the two webs at an interval, and the web structure is connected with at least one of the plurality of vertical plates of the mounting frame through at least one of the plurality of rib plates.

4. The chassis component as claimed in claim 3, wherein the sleeper beam further comprises:

an upper cover plate, covering the two webs, the upper cover plate being provided with a plurality of through holes, at least one of the rib plates being provided with a bulge, and the bulge matching a corresponding through hole in the plurality of through holes; and a lower cover plate, provided at a lower part of each of the two webs, the lower cover plate being fixedly connected with each of the plurality of rib plates.

5. The chassis component as claimed in claim 3, wherein the sleeper beam further comprises two inner boundary beams, the two inner boundary beams being provided at an interval, the two inner boundary beams being in one-to-one corresponding connection with the two lower boundary beams, and each of the inner boundary beams being connected with the two webs of at least one of the web structures.

6. The chassis component as claimed in claim 1, further comprising: a plurality of cross beam components provided between the two lower boundary beams, the plurality of cross beam components being provided at an interval along a length direction of each of the two lower boundary beams, at least one of the two lower boundary beams being provided with a connecting seat, and at least one end of each of the plurality of cross beam components being connected with a corresponding lower boundary beam in the two lower boundary beams through the connecting seat.

7. The chassis component as claimed in claim 6, wherein each of the two lower boundary beams comprises a first flat plate, a vertical plate and a second flat plate connected in sequence, a width size L1 of the first flat plate is greater than a width size L2 of the second flat plate, and the connecting seat comprises:

a first connecting plate, connected with the vertical plate;

a second connecting plate, forming an included angle with the first connecting plate, the second connecting plate being connected with a corresponding cross beam component in the plurality of cross beam components; and a third connecting plate, forming an included angle with the first connecting plate and the second connecting plate respectively, the third connecting plate being connected with the first flat plate or the second flat plate.

8. The chassis component as claimed in claim 7, wherein the first connecting plate is welded to the vertical plate and the third connecting plate is welded to the first flat plate, or, the first connecting plate is welded to the vertical plate and the third connecting plate is welded to the second flat plate.

9. The chassis component as claimed in claim 8, wherein at least one cross beam component in the plurality of cross beam components comprises:

a first cross beam, two opposite ends of the first cross beam being correspondingly connected with the two lower boundary beams respectively; and a second cross beam, the second cross beam and the first cross beam being correspondingly provided in a height direction of each of the two lower boundary beams.

10. The chassis component as claimed in claim 9, wherein at least one of the two lower boundary beams is provided with two connecting seats, and the first cross beam and the second cross beam are connected with the lower boundary beam through corresponding connecting seats respectively.

11. The chassis component as claimed in claim 6, wherein in a height direction of each of the two lower boundary beams, at least one of the plurality of cross beam components comprises a first cross beam and a second cross beam provided below the first cross beam, the first cross beam and the second cross beam form a mounting cavity, and a part of a floor of the railway vehicle is inserted in the mounting cavity.

12. The chassis component as claimed in claim 11, wherein the first cross beam comprises a U-shaped beam and a connecting beam connected with the U-shaped beam, the connecting beam being connected with the floor; and the second cross beam comprises a first horizontal beam, a vertical beam and a second horizontal beam connected in sequence, the first horizontal beam and the second horizontal beam being located on two sides of the vertical beam respectively, and the first horizontal beam being connected with a side, away from the first cross beam, of the floor.

13. The chassis component as claimed in claim 7, further comprising:

a middle beam, provided between the two lower boundary beams, the middle beam extending along the length direction of each of the two lower boundary beams, and a cross section of the middle beam being Z-shaped in a width direction of the railway vehicle.

14. The chassis component as claimed in claim 13, wherein the middle beam comprises a first horizontal segment, a vertical segment and a second horizontal segment connected in sequence, the first horizontal segment and the second horizontal segment being provided on two opposite sides of the vertical segment respectively.

15. The chassis component as claimed in claim 14, wherein the railway vehicle further comprises a floor, the floor covering the middle beam, and the floor being connected with each of the two lower boundary beams; and the chassis component further comprises a cover plate, the cover plate being connected with the middle beam, the middle beam being located between the floor and the cover plate, and the floor, the cover plate and the middle beam jointly enclosing a main air duct of the railway vehicle.

16. The chassis component as claimed in claim 1, further comprising:

a pipe passage structure, one side, facing a vehicle body of the railway vehicle, of at least one of the two lower boundary beams being provided with the pipe passage structure, wherein the pipe passage structure is a pipe passage channel provided on the lower boundary beam.

17. The chassis component as claimed in claim 16, further comprising a first reinforcing member, wherein the first reinforcing member is located on one side, away from the vehicle body, of the pipe passage structure, and the first reinforcing member is connected with a part of a corresponding lower boundary beam in the two lower boundary beams.

18. The chassis component as claimed in claim 17, further comprising a main air duct and a branch air duct communicated with the main air duct, wherein each of the two lower boundary beams is provided with a ventilation opening communicated with the branch air duct.

19. A railway vehicle, comprising a vehicle body structure and a chassis component connected with the vehicle body structure, wherein the chassis component is the chassis component as claimed in claim 1.

20. A chassis component of a railway vehicle, comprising two lower boundary beams provided at an interval and a sleeper beam provided between the two lower boundary beams, the sleeper beam comprising:

a web structure;

a center pin, connected with a bogie of a railway vehicle; and a mounting frame, connected with the web structure, the center pin being provided on the mounting frame, the mounting frame comprising a plurality of vertical plates, and the plurality of vertical plates being provided at an interval along an outer wall surface of the center pin;

the chassis component further comprises: a plurality of cross beam components provided between the two lower boundary beams, the plurality of cross beam components being provided at an interval along a length direction of each of the two lower boundary beams, at least one of the two lower boundary beams being provided with a connecting seat, and at least one end of each of the plurality of cross beam components being connected with a corresponding lower boundary beam in the two lower boundary beams through the connecting seat;

wherein each of the two lower boundary beams comprises a first flat plate, a vertical plate and a second flat plate connected in sequence, a width size L1 of the first flat plate is greater than a width size L2 of the second flat plate, and the connecting seat comprises:

a first connecting plate, connected with the vertical plate;

a second connecting plate, forming an included angle with the first connecting plate, the second connecting plate being connected with a corresponding cross beam component in the plurality of cross beam components; and a third connecting plate, forming an included angle with the first connecting plate and the second connecting plate respectively, the third connecting plate being connected with the first flat plate or the second flat plate.

* * * * *